United States Patent [19]

Sato et al.

[11] Patent Number: 4,881,986

[45] Date of Patent: Nov. 21, 1989

[54] METHOD FOR PRODUCING A RARE EARTH METAL-IRON-BORON ANISOTROPIC SINTERED MAGNET FROM RAPIDLY-QUENCHED RARE EARTH METAL-IRON-BORON ALLOY RIBBON-LIKE FLAKES

[75] Inventors: Tadakuni Sato; Yuichi Tachiya, both of Miyagi, Japan

[73] Assignee: Tokin Corporation, Miyagi, Japan

[21] Appl. No.: 138,250

[22] Filed: Nov. 25, 1987

[30] Foreign Application Priority Data

| | | | |
|---|---|---|---|
| Nov. 26, 1986 | [JP] | Japan | 61-279645 |
| Nov. 29, 1986 | [JP] | Japan | 61-285757 |
| Jan. 23, 1987 | [JP] | Japan | 62-12590 |
| Jan. 28, 1987 | [JP] | Japan | 62-16040 |
| Mar. 24, 1987 | [JP] | Japan | 62-67943 |
| Mar. 31, 1987 | [JP] | Japan | 62-79016 |
| Jun. 30, 1987 | [JP] | Japan | 62-160966 |
| Jul. 24, 1987 | [JP] | Japan | 62-183597 |
| Jul. 25, 1987 | [JP] | Japan | 62-184698 |
| Sep. 5, 1987 | [JP] | Japan | 62-221219 |
| Sep. 7, 1987 | [JP] | Japan | 62-222109 |

[51] Int. Cl.[4] ..... B22F 3/12

[52] U.S. Cl. ..... 148/103; 148/104; 419/12; 419/23

[58] Field of Search ..... 419/12, 23; 148/103, 148/104

[56] References Cited

FOREIGN PATENT DOCUMENTS

| | | |
|---|---|---|
| 0101552 | 7/1983 | European Pat. Off. . |
| 197712 | 10/1986 | European Pat. Off. . |
| 59-46008 | 3/1984 | Japan . |
| 59-64739 | 4/1984 | Japan . |
| 60-9852 | 1/1985 | Japan . |
| 60-89546 | 5/1985 | Japan . |
| 162750 | 8/1985 | Japan . |
| 60-189901 | 2/1986 | Japan . |

OTHER PUBLICATIONS

Koon, N. C. et al., "Magnetic properties of amorphous and crystallized ($Fe_{0.82}B_{0.18}$), 9 $Ib_{0.05}La_{0.05}$", *Appln. Phys. Letter,* vol. 39, No. 10, Nov. 15, 1981, pp. 840–842.

Mishra et al., "Microstructure of Melt-Spun Nd-Fe-B Magnequench Magnets", *Journal of Magnetism and Magnetic Materials,* 54–57, 1986, pp. 450–456.

Egami, "Low Field Magnetic Properties of Amorphous Alloys", *Journal of the American Ceramic Society,* vol. 60, No. 3–4, Mar., Apr. 1977, pp. 128–133.

Lee et al., "Processing Neodymium-Iron-Boron Mett-Spun Ribbons to Fully Dense Magnets"; *IEEE Transactions on Magnetics,* vol. Mag.-21, No. 5, Sep. 1985, pp. 1958–1963.

Croat et al., "High-energy product Nd-Fe-B permanent magnets", *Applied Physics Letters,* vol. 44, No. 1, Jan. 1984, pp. 148–149.

Patent Abstracts of Japan, vol. 11, No. 343, Nov. 10, 1987, JP-A-62 124 702 (Toshiba Corp.), 6-6-87.

*Primary Examiner*—Deborah Yee

*Attorney, Agent, or Firm*—Hopgood, Calimafde, Kalil, Blaustein & Judlowe

[57] ABSTRACT

In a method for producing a rare earth metal-iron-boron (R-Fe-B) anisotropic sintered magnet from R-Fe-B alloy ribbon-like flakes, each flake is formed with a thickness of about 20–500 μm and contains $R_2Fe_{14}B$ crystal grains dispersed in the flake with an average grain size of 10 μm or less. The flakes are ground into a powder having an average particle size less than the thickness value of the flake. The powder is magnetically aligned and compacted into a compact body which is then sintered. Thus, the anisotropic sintered magnet is obtained with a high energy product and a high anti-corrosion property. The ribbon-like flakes are prepared by the continuous splat-quenching method. Alternatively, the flakes can be prepared by spraying the molten R-Fe-B alloy in a form of particles and cooling the particles on a cooling plate into flat small pieces.

18 Claims, 12 Drawing Sheets

METHOD FOR PRODUCING A RARE EARTH METAL-IRON-BORON ANISOTROPIC SINTERED MAGNET FROM RAPIDLY-QUENCHED RARE EARTH METAL-IRON-BORON ALLOY RIBBON-LIKE FLAKES

BACKGROUND OF THE INVENTION (1) Field of the Invention

This invention relates to a rare earth metal-transition metal-boron (R-T-B) permanent magnet with a high energy product and, in particular, to a method for producing such permanent magnets with anisotropy by sintering compact bodies of rapidly-quenched R-T-B alloy powder. (2) Description of the Prior Art As an R-T-B permanent magnet alloy,, N. C. Koon and B. N. Das disclosed magnetic properties of amorphous and crystallized alloy of $(Fe_{0.82}B_{0.18})_{0.9}Tb_{0.05}La_{0.05}$ in Appl. Phys. Lett. 39(10) (1981), 840 (Reference 1). They wrote that crystallization of the alloy occurred near the relatively high temperature of 900 K., which also marked the onset of dramatic increase in the intrinsic coercive force. They found out that the alloy in the crystallized state appeared potentially useful as low cobalt permanent magnets.

J. J. Croat proposed amorphous R-Fe-B (Nd and/or Pr is especially used for R) alloy having magnetic properties for permanent magnets as disclosed in JP-A-59064739 (Reference 2, which is corresponding to U.S. patent application Serial Nos. 414936 and 508266) and JP-A-60009852 (Reference 3, which is corresponding to U.S. patent application Ser. Nos. 508266 and 544728). References 2 and 3 disclose to use other transition metal elements in place of or in part of Fe. Those magnetic properties were considered to be caused by a microstructure where $Nd_2Fe_{14}B$ magnetic crystal grains having a grain size of 20–400 nm were dispersed within an amorphous Fe phase. Reference is further made to R. K. Mishra: J. Magnetism and Magnetic Materials 54–57 (1986) 450 (Reference 4).

The rapidly-quenched alloy ribbon is prepared by the continuous splat-quenching method which is disclosed in, for example, a paper entitled "Low-Field Magnetic Properties of Amorphous Alloys" written by Egami, Journal of the American Ceramic Society, Vol. 60, No. 3-4, March-April 1977, p.p. 128–133 (Reference 5). A similar continuous splat-quenching method is disclosed as a "Melt Spinning" method in References 2 and 3. That is, R-T-B molten alloy is ejected through a small orifice onto an outer peripheral chill surface of a copper disk rotating at a high speed. The molten alloy is rapidly quenched by the disk to form a rapidly-quenched ribbon. Then, a comparatively high cooling rate produces an amorphous alloy but a comparatively low cooling rate crystallises the metal.

According to References 2 and 3, the principal limiting factor for the rate of chill of a ribbon of alloy on the relatively cooler disc surface is its thickness. If the ribbon is too thick, the metal most remote from the chill surface will cool too slowly and crystallise in a magnetically soft state. If the alloy cools very quickly, the ribbon will have a microstructure that is somewhere between almost completely amorphous and very, very finely crystalline. That is, the slower cooling surface of the ribbon farthest from the chill surface is more crystallised but the other quickly cooling surface impinging the chill surface is hardly crystallised, so that crystallite size varies throughout the ribbon thickness.

References 2 and 3 describe that those magnetic materials exhibiting substantially uniform crystallite size across the thickness of the ribbon tend to exhibit better permanent magnetic properties than those showing substantial variation in crystallite size throughout the ribbon thickness.

In order to produce a practical magnet, the amorphous alloy is crushed and formed into a bonded magnet. Reference is made to a paper entitled "PROCESSING OF NEODYMIUM-IRON-BORON MELT-SPUN RIBBONS TO FULLY DENSE MAGNETS" presented by R. W. Lee et al at the International Magnetics Conference, held at St. Paul, Minn., on Apr. 29, 1985, and published in IEEE Transactions on Magnetics, Vol. MAG-21, No. 5, September 1985, Page 1958 (Reference 6).

Generally speaking, the amorphous alloy can provide only an isotropic magnet because of its crystallographically isotropy. This means that a high performance anisotropic permanent magnet cannot be obtained from the amorphous alloy. However, Reference 6 also discloses that magnetic alignment was strongly enhanced by upsetting fully dense hot-pressed samples of crushed amorphous alloy. But the technique cannot yet provide an anisotropic permanent magnet having a satisfactorily high energy product. For example, the hot-pressed magnet has a residual magnetic flux density Br of 7.9 kGauss, an intrinsic coercive force $_IH_C$ of 16 kOe, and an energy product (BH)max of 13 MGOe.

JP-A-60089546 (Reference 7) discloses a rapidly quenched R-Fe-B permanent magnet alloy with a high coercive force. The alloy contains very fine composite structures less than 5 μm predominant of tetragonal crystal compositions and is crushed into powders having particle sizes of −100 Tyler mesh (less than 300 μm) to produce a bonded magnet. Although Reference 7 describes possibility of application of the crushed powders to a sintered magnet and a c-axis anisotrophy appreciated by application of X-ray diffraction microscopy to a surface of the alloy, no anisotropic sintered permanent magnet is disclosed. In practice, the crushed powder cannot be magnetically aligned and a sintered magnet therefore cannot be obtained with a high magnetic anisotropy.

Sagawa et al proposed an anisotropic R-Fe-B sintered magnet in JP-A-59046008 (Reference 8) which was produced from an ingot of an alloy of R (especially Nd), Fe, and B by a conventional powder metallurgical processes. The sintered magnet has more excellent magnetic properties for permanent magnets than the known Sm-Co magnets.

However, the R-Fe-B alloy tends to be oxidized in the production of the magnet, because the R-Fe-B alloy ingot comprises the magnetic crystalline phase of the chemical compound $R_2Fe_{14}B$ and the R-rich solid solution phase and because the solid solution phase is very active to oxygen. Further, the solid solution phase is difficult to be uniformly ground into particles. Accordingly, it is difficult to produce an anti-corrosion anisotropic sintered magnet having a high energy product.

It is known in the prior art that the rapidly quenched R-T-B alloy ribbon is readily ground into powder having a small distribution of particle sizes and that is has a high corrosion resistance in comparison with the alloy ingot.

SUMMARY OF THE INVENTION

Therefore, it is an object of the present invention to provide a method for producing an anisotropic sintered permanent magnet from the rapidly quenched R-T-B alloy ribbon-like flakes.

It is another object of the present invention to provide an anisotropic sintered magnet having excellent magnetic properties, for example, $(BH)_{max}$ of higher than 13 MGOe.

It is still another object of the present invention to provide a method for preparing a rapidly-quenched alloy powder each particle having a high uniform crystal orientation.

The present invention is directed to a method for producing a rare earth-transition metal-boron (R-T-B) sintered magnet by preparing an R-T-B alloy powder containing $R_2T_{14}B$ crystal grains, putting the powder in a magnetic field and compacting the powder into a compact body of a desired shape, and sintering the compact body at a sintering temperature thereby to produce the sintered magnet. According to the present invention, the R-T-B alloy powder is a rapidly quenched alloy powder produced by steps of preparing the R-T-B alloy in a molten state, rapidly quenching the molten R-T-B alloy to form ribbons and/or ribbon-like flakes, each ribbon and/or flake having a thickness and containing the crystal grains uniformly dispersed in the ribbon and/or flake, the crystal grains having an average grain size, and crushing and grounding the ribbons and/or flakes into a powder of an average particle size of a value less than the thickness, each particle of the powder containing the crystal grains extending in a direction, to thereby enable the powder to be magnetically aligned in the magnetic field.

Each ribbon and/or flake desirably has a thickness of 20–500 μm (preferably 50–500 μm), and the crystal grains have an average grain size of 10 μm or less (preferably 1–10 μm).

It is desired that the crushed and ground powder has an average particle size of 0.3–15 μm (preferably 1.5–3 μm).

The sintering is desired to be carried out so that said crystal grains are grown to have a grain size of 7–30 μm.

It is also desired that the R-T-B alloy powder consists, by weight, of R 28.0–65.0%, and the balance of T and B. The transition metal elements T in the R-T-B alloy may be Fe and Co represented by $Fe_{1-x}Co_x$, x being 0.35 or less.

The ribbons and/or flakes can be produced by the continuous splat-quenching method, that is, the molten R-T-B alloy is ejected through a small orifice onto an outer peripheral chill surface of a quenching disk rotating at a predetermined speed, and the ejected molten alloy is thereby rapidly cooled into the rapidly-quenched ribbons and/or ribbon-like flakes.

According to another aspect of the present invention, the molten alloy is sprayed or atomized onto a cooling plate to form flat ribbon-like flakes.

In order to produce the powder comprising particles which have crystal grains with a reduced grain size distribution, the molten alloy is rapidly quenched on opposite sides of the ribbon or flake but at quenching start times offset from each other.

To the same end, the rapidly-quenched powder can be subjected to a heat treatment at a temperature of 650°–950° C.

DESCRIPTION OF THE INVENTION

Figure 1:
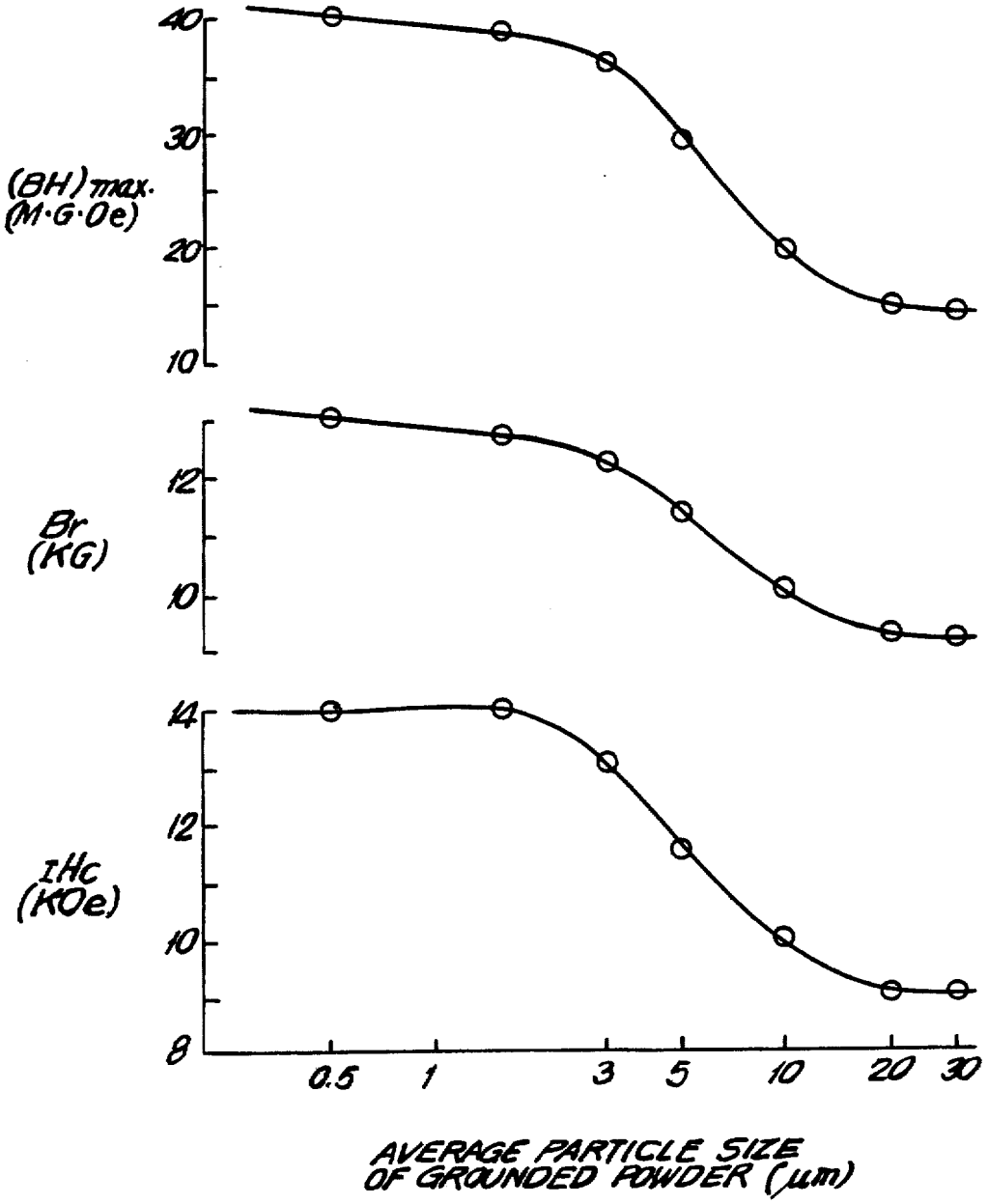
FIG. 1 is a graph showing magnetic properties of sintered magnets in Example 1 together with average particle sizes of used powders.

The present invention was made on the following novel facts observed by the present inventors. That is, the inventors found out that the magnetic crystal of $R_2T_{14}B$ such as $Nd_2Fe_{14}B$ had a predominant grain growing direction in the C-plane of the crystal. Further, the C-plane of the crystal in the rapidly-quenched R-T-B alloy ribbon tends to orient in a direction parallel to the main surface of the ribbon when the crystal is grown in a grain size 5 μm or less. When the crystal grain grows larger than 5 μm, the crystal grows in a needle-like form and the C-plane of the crystal has an orientation in a direction perpendicular to the main surface of the ribbon.

Those facts teach us that the rapidly-quenched alloy ribbon has a high anisotropy when crystals are uniformly grown to have a generally equal and comparatively large grain size. Then, it will be noted that a powder obtained by grounding the rapidly-quenched anisotropic alloy ribbon can be magnetically aligned in a magnetic field so that an anisotropic sintered magnet can be produced through magnetic aligning, pressing, and sintering steps.

However, in the continuous splat-quenching method, sizes of grains vary across the thickness of the ribbon because the cooling speed is different between the chill surface and the free surface of the ribbon. Accordingly, the orientations of grains also vary in the direction of the thickness.

In this connection, the present inventors further found out that orientations of adjacent crystal grains were generally equal, even if orientations were different between crystal grains distant from one another in the direction of thickness of the ribbon.

Briefly stating, the present invention attempts to make an R-T-B alloy powder with a high anisotropy by grounding the rapidly-quenched alloy ribbon into a powder having an average particle size of a value less than the thickness of the ribbon, thereby to obtain a powder of separated particles, each particle containing crystal grains with C-planes generally extending in one direction. The ground powder can be magnetically aligned and compacted into a desired shape which is sintered into an anisotropic sintered magnet with a high energy product.

Now, description will be made as to examples of the present invention.

EXAMPLE 1

An ingot of an alloy consisting of R 35.0 wt%, B 0.9 wt%, and substantially balance of Fe was prepared by the induction melting in argon gas atmosphere. Starting materials used for R, B, and Fe, were Nd of a purity factor of 97% including other rare earth metal elements mainly Ce and Pr, ferroboron containing B 20 wt%, and electrolytic iron, respectively.

The ingot was again melted by the induction melting in argon gas. The molten alloy was ejected through a small orifice on to an outer chill surface of a copper disk rotating at a chill surface moving speed of 15 m/sec to produce a rapidly-quenched alloy ribbon having a width of 5 mm and a thickness of about 100 μm. The ribbon showed fine $R_2Fe_{14}B$ crystal grains dispersed in the ribbon and having an average grain size of 0.1 μm.

The ribbon was crushed and ground by means of a ball mill to produce seven molding powders having average particle sizes of 0.5 μm, 1.5 μm, 3.0 μm, 5.0 μm, 10.0 μm, 15.0 μm, and 30.0 μm, respectively.

Each of those seven powders was pressed into a compact body under a pressure of 1 ton.f/cm$^2$ in a magnetic field of 20 kOe. The compact body was sintered by holding at 1,050° C. in vacuum for one hour and in argon gas for next succeeding one hour, and then quenched to obtain a sintered body. The sintered body was subjected to an aging at a temperature of 630° C. in argon gas for one hour. Thereafter, the sintered body was magnetized in a magnetic field of about 30 kOe to produce a magnet.

The magnet was measured as to magnetic properties, that is, residual magnetic flux density Br, coercive force $_IH_C$, and maximum energy product $(BH)_{max}$.

The measured properties are shown in FIG. 1 in relation to the average particle sizes of the molding powders.

FIG. 1 teaches us that $(BH)_{max}$ is larger than 16 MGOe for the average particle size smaller than 15 μm which is considerably smaller than the size of the ribbon thickness.

It is also noted from FIG. 1 that $(BH)_{max}$ is increased for the average particle size smaller than 10 μm and is further increased for 5 μm or less average particle size.

There is no lower limit for the average particle size of the molding powder, but 0.3 μm or more is desired in practical use.

EXAMPLE 2

An alloy ingot consisting of R 40 wt%, B 1.0 wt%, and the balance of Fe was made in the similar manner as in Example 1. A start material of R consisted of cerium didymium consisting of Ce 5 wt%, Pr 15 wt%, and the substantially balance of Nd and an addition of 5 at% Dy. Ferroboron and electrolytic iron were also used for start materials of B and Fe.

Using a quenching disk rotating at a chill surface speed of 30 m/sec, a rapidly-quenched alloy ribbon was produced from the alloy ingot in the similar manner as in Example 1. The ribbon had a width of about 2 mm and a thickness of about 50 μm. The $R_2Fe_{14}B$ crystal grains dispersed in the ribbon had an average grain size of about 0.01 μm.

The ribbon was crushed and ground into two powders having average particle sizes of 2.0 μm and 20.0 μm, respectively.

Two sintered magnets were produced from the two powders, respectively, and were measured as to the magnetic properties in a manner similar to Example 1.

The measured data are shown in Table 1.

TABLE 1

| GROUND PARTICLE SIZE (μm) | Br (kG) | $_IH_C$ (kOe) | $(BH)_{max}$ (M.G.Oe) |
|---|---|---|---|
| 2.0 | 11.3 | 19.0 | 31.0 |
| 20.0 | 9.0 | 12.5 | 14.5 |

It is noted from Table 1 that use of the powder of average particle size 2.0 μm provides high magnetic properties in comparison with another powder of a large average particle size.

EXAMPLE 3

Using Nd of a purity factor 97% (including Pr, Ce and other rare earth metals), ferroboron, electrolytic iron, electrolytic cobalt, and aluminium of a purity factor of 99.9%, an ingot was prepared in the similar manner as in Example 1. The ingot consisted of R 40.0 wt%, B 0.9 wt%, and the balance of $Fe_{77}Co_{20}Al_3$.

Rapidly-quenched ribbon-like flakes were obtained from the ingot by the continuous splat-quenching method similar to the method in Example 1 but using a quenching disk rotating at a chill surface speed of 5 m/sec. Each flake had a width of about 5 mm and a thickness of about 150 μm. An average size of crystal grains dispersed in each flake was about 0.5 μm.

These flakes were crushed and ground into two powders having average particle sizes of 2.5 μm and 20.0 μm, respectively.

Two magnets were produced from the two powders, respectively, in the similar manner as described in Example 1 and were measured as to the magnetic properties which are shown in Table 2.

TABLE 2

| GROUND PARTICLE SIZE (μm) | Br (kG) | $_IH_C$ (kOe) | $(BH)_{max}$ (M.G.Oe) |
|---|---|---|---|
| 2.5 | 11.2 | 15.0 | 30.0 |
| 20.0 | 8.8 | 10.5 | 13.5 |

The magnetic properties of the magnet made from powder of 2.5 μm particle size is superior to another magnet made from the 20.0 μm particle size powder.

EXAMPLE 4

Using the similar start materials as in Example 1, an R-T-B alloy ingot was also prepared in the similar manner as in Example 1. Amount of the start materials was adjusted so that the ingot consisted of R 32.0 wt%, B 1.0 wt%, and the balance of Fe.

Seven rapidly-quenched ribbons were prepared from the alloy by the continuous splat-quenching method similar to that in Example 1 at different chill surface speeds within a range over about 2–50 m/sec, respectively. The seven ribbons had different width within a size range of 1–15 mm and different thickness sizes of 10 μm, 20 μm, 50 μm, 100 μm, 200 μm, 500 μm, and 1000 μm, respectively.

The following facts were found out by X-ray diffraction microanalysis of these alloy ribbons: (1) Each alloy ribbon contains $R_2Fe_{14}B$ crystal grains dispersed therein; (2) The crystal grains have sizes of 3 μm or less for each ribbon having a thickness of 200 μm or less, and 10 μm or less for each ribbon having a thickness of 500 μm or less, while the ribbon having 1000 μm thickness contains crystal grains larger than 20 μm size; and (3) Each crystal grain of a size of 5 μm or less has a C-plane generally oriented in a direction parallel to a main surface of the ribbon, while each crystal grown larger than 5 μm size is in a needle like crystal and has a C-plane extending in a direction perpendicular to the main surface of the ribbon.

Each ribbon was crushed and ground into a powder having an average particle size of 3 μm, and the powder was pressed into a compact body under a pressure of 2 ton.f/cm² in an aligning magnetic field of 20 kOe. The compact body was sintered by holding at a temperature of 1,080° C. in vacuum for one hour and in argon gas for next succeeding one hour, and then was quenched. The sintered body was aged at 630° C. for 2 hours in argon gas. Thereafter, a magnetic field of 30 kOe was applied to the sintered body to form a magnet. Magnetic properties of the magnet was measured.

Figure 2:
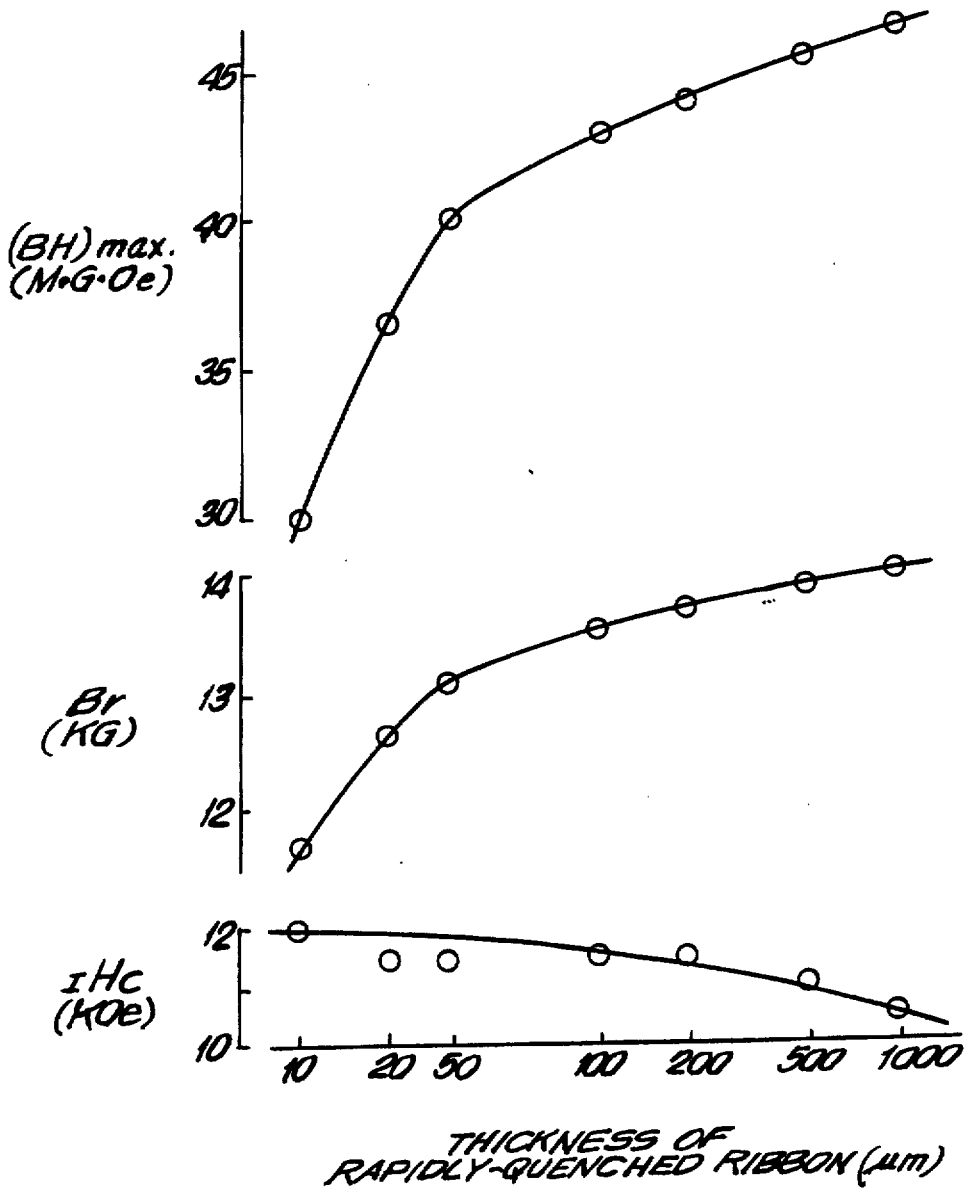
FIG. 2 is a graph showing magnetic properties of sintered magnets in Example 4 together with thickness of rapidly-quenched ribbons.

FIG. 2 shows the measured magnetic properties of the magnet in connection with ribbon thickness size of the powder used for the magnet.

It will be noted from FIG. 2 that $(BH)_{max}$ and Br are considerably increased by the use of ribbon thickness of 20 μm or more while $_IH_C$ is remarkably reduced by the use of 1000 μm thickness ribbon.

EXAMPLE 5

Using the similar start materials, an alloy ingot was prepared to consist of R 30.0 wt%, B 1.1 wt%, and the balance of Fe. Then, ribbons and/or ribbon-like flakes were obtained from the alloy ingot by the similar continuous splat-quenching method in use of a steel quenching disk. The width and the thickness of the ribbon or flakes were controlled over a range of about 1–10 mm and a range of about 10–500 μm, respectively, by changing the chill surface moving speed over a range of about 1–60 m/sec.

Some of the obtained ribbons were amorphous alloy for higher chill surface speeds and the remaining ribbons and flakes contain the crystal grains having an average grain size of 0.001–10 μm, while crystals contained in individual ribbon or flake has a small grain size distribution.

Those ribbons or flakes obtained by different chill surface speeds were separately crushed and ground to form individual powders having an average particle size of about 2.5 μm. Each powder was compacted into a compact body by a pressing force of 1 ton.f/cm² within an aligning magnetic field of 20 kOe, and the compacted body was sintered at 1,070° C. for one hour in vacuum and for next succeeding one hour in argon gas, thereafter being quenched. The sintered body was aged at 650° C. for two hours in argon gas, and then magnetized by application of a magnetic field of about 30 kOe to form a magnet. The magnet was subjected to measurement of its magnetic properties.

Figure 3:
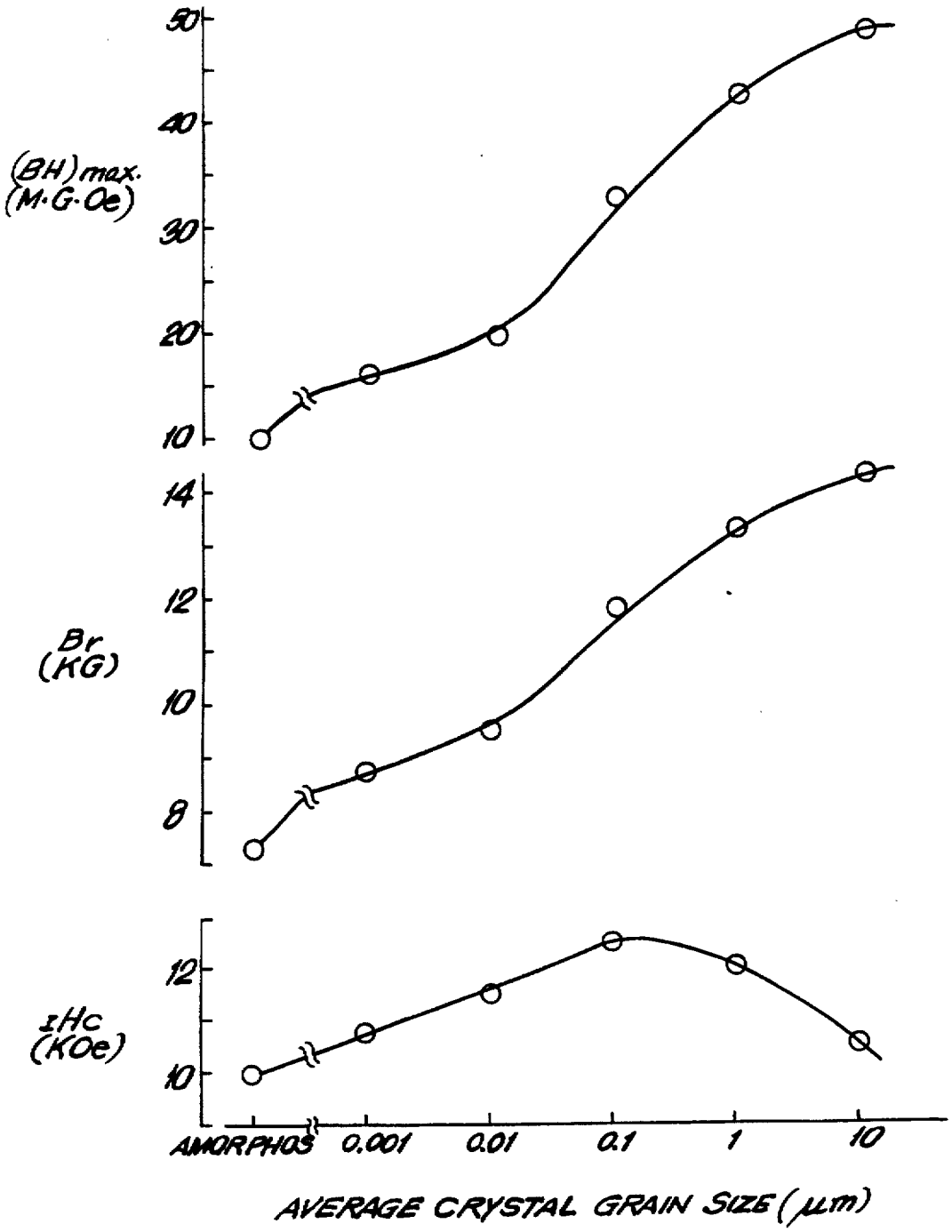
FIG. 3 is a graph showing magnetic properties of sintered magnets in Example 5 together with average grain sizes of crystals in rapidly-quenched ribbons.

The measured data of the magnets made from the individual powders are shown in FIG. 3 together with average crystal grain sizes in the powders.

It will be understood from FIG. 3 that use of rapidly-quenched alloy containing crystal grains improves magnetic properties in comparison with use of amorphous alloy. However, if the average crystal grain size is larger than about 10 μm, a high $_IH_C$ is not obtained in comparison with use of the amorphous alloy.

EXAMPLE 6

An alloy ingot was used from the similar starting materials by the similar producing method as in Example 2. The alloy ingot consisted of R 35.0 wt%, B 0.9 wt%, and the balance of Fe.

The alloy ribbons were prepared by the method similar to that in Example 4 but at different chill surface speeds. The two ribbons have width sizes of about 2 mm and 10 mm and thickness sizes of 15 μm and 100 μm for the chill surface speeds of 50 m/sec and 10 m/sec, respectively.

Crystal grains in the 15 μm thick ribbon were measured smaller than a submicron meter in size and C-planes of some grains were merely observed to be oriented in parallel to the main surface of the ribbon. While the other ribbon having the thickness of 100 μM contained crystal grains of about 2 μm or less, C-planes of which were mostly oriented in parallel direction to the main surface of the ribbon.

Two magnets were produced from the two alloy ribbons by the similar steps as in Example 4, and the magnetic properties of the magnets were measured. The measured data are demonstrated in Table 3.

TABLE 3

| THICKNESS OF ALLOY RIBBON (μm) | Br (kG) | $_IH_C$ (kOe) | $(BH)_{max}$ (M.G.Oe) |
|---|---|---|---|
| 15 | 11.4 | 15.5 | 29.0 |
| 100 | 12.2 | 15.0 | 35.5 |

It is noted that the magnet made from the 100 μm thickness ribbon has more excellent magnetic properties than the other magnet made from the 15 μm thickness ribbon.

EXAMPLE 7

An alloy ingot consisting of R 40.0 wt%, B 1.0 wt%, and the balance of Fe was prepared in the manner as in Example 6. Then, an alloy ribbon having a width of about 3 μm and a thickness of about 60 μm was made by the continuous splat-quenching method using a steel quenching disk in a similar manner as in Example 5.

A magnet was obtained from the alloy ribbon by the similar steps in Example 5 but using 1,050° C. and 650°

C. for the sintering and aging temperature. The magnetic properties of the magnet is shown in Table 4.

TABLE 4

| Br (kG) | $_{I}H_{C}$ (kOe) | $(BH)_{max}$ (M.G.Oe) |
|---|---|---|
| 11.4 | 16.5 | 31.0 |

EXAMPLE 8

Using the similar starting materials in Example 3, an alloy ingot was prepared in the similar manner. The alloy ingot consisted of R 40.0 wt%, B 1.1 wt%, and the balance of $Fe_{77}Co_{20}Sl_3$ From the ingot, two ribbons with thickness sizes of about 15 μm and 100 μm, respectively, were made by the similar manner as in Example 5. Two magnets were produced from these ribbons in the similar steps as in Example 4 but using a sintering temperature of 1030° C. and an aging condition of 650° C. for one hour.

Individual magnetic properties of the magnets are shown in Table 5.

TABLE 5

| THICKNESS OF ALLOY RIBBON (μm) | Br (kG) | $_{I}H_{C}$ (kOe) | $(BH)_{max}$ (M.G.Oe) |
|---|---|---|---|
| 15 | 10.7 | 14.5 | 26.5 |
| 100 | 11.4 | 14.0 | 31.0 |

EXAMPLE 9

In the similar manner as in Example 8, an alloy ingot was prepared which consisted of R 40.0 wt%, B 0.9 wt%, and the balance of $Fe_{77}Co_{20}Al_3$. Then, an alloy ribbon with a width of about 3 mm and a thickness of about 60 μm was produced from the ingot by the similar method as in Example 7. From the alloy ribbon, a magnet was made in the similar manner as in Example 5 but using a sintering temperature of 1,050° C. and an aging temperature of 630° C. The obtained magnet has magnetic properties as shown in Table 6.

TABLE 6

| Br (kG) | $_{I}H_{C}$ (kOe) | $(BH)_{max}$ (M.G.Oe) |
|---|---|---|
| 10.9 | 14.0 | 28.5 |

EXAMPLE 10

Using the similar starting materials as in Example 1, nine alloy ingots were produced in the manner as described in Example 1. Those nine ingots contains the same amount of B 1.0 wt%, different amounts of R in a range of 27.5–65.0 wt%, and the balance of Fe. From these nine ingots, nine rapidly-quenched alloys were made by the continuous splat-quenching method using a steel quenching disk rotating a different chill surface moving speeds over a range of 10–20 m/sec. The rapidly-quenched alloys had a width of about 5 mm with thickness ranging over about 50–100 μm in dependence of the chill surface speeds and each alloy contained fine crystal grains of an average grain size of about 0.2 μm. Some of the alloys were lengthy ribbons and the remaining ones were ribbon-like flakes.

Those nine rapidly-quenched alloys were crushed and ground into nine powders each having an average particle size of about 2.5 μm. Nine compact bodies were formed from the nine powders by pressing force of 1 ton.f/cm² in an aligning magnetic field of 20 kOe.

These compact bodies were sintered at different sintering temperatures from each other by 50° C. within the range of 700°–1,500° C. for two hours but in vacuum for the beginning one hour and in argon gas for the succeeding one hour, and then were quenched. The resultant sintered bodies were aged at 650° C. in argon gas for two hours.

The sintered bodies were magnetized by application of a magnetic field of about 30 kOe to form nine magnets, which were subjected to measurement of magnetic properties.

Figure 4:
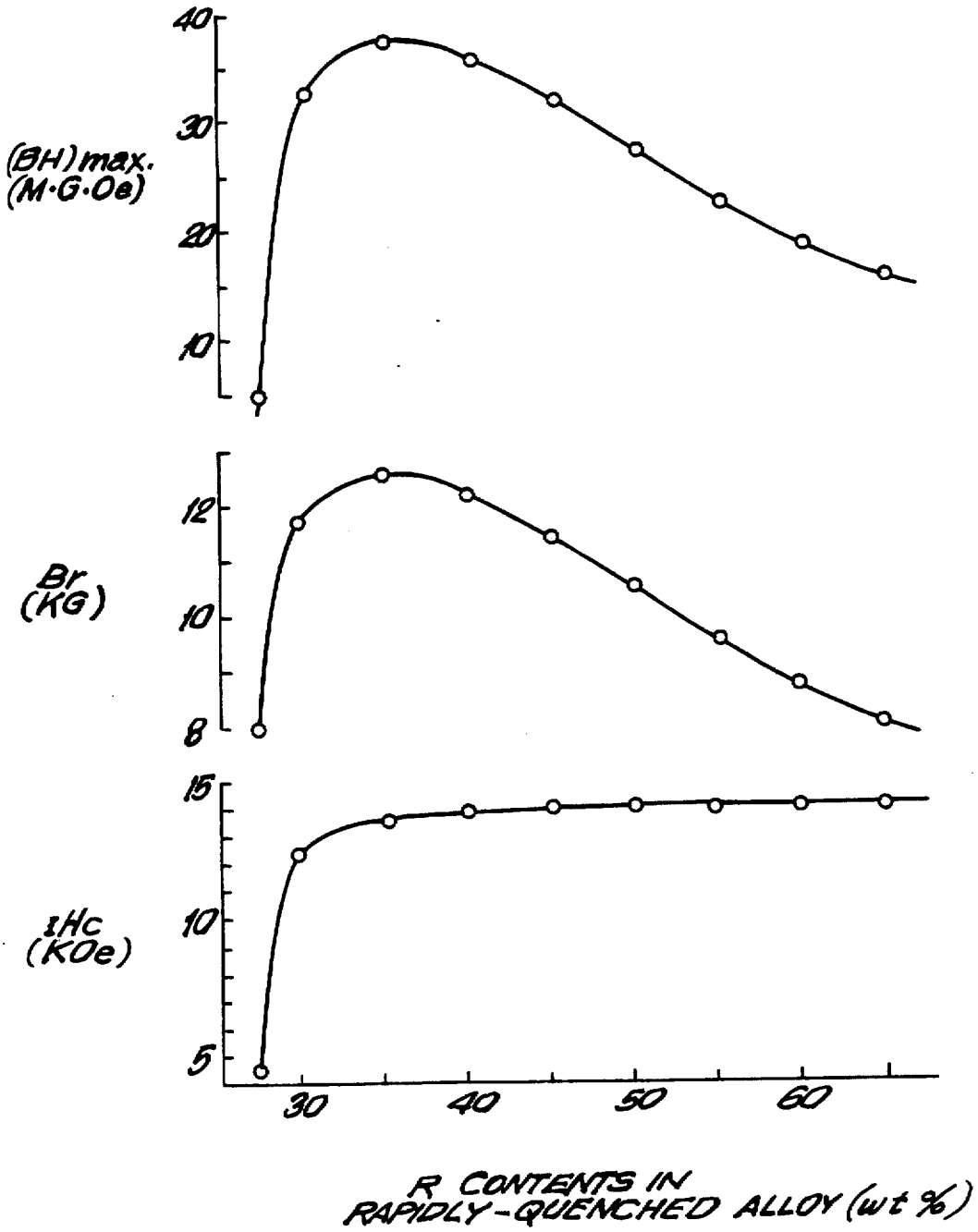
FIG. 4 is a graph showing magnetic properties of sintered magnets in Example 10 together with R contents in rapidly-quenched alloys.

The measured magnetic properties are shown in FIG. 4 together with R contents in the rapidly-quenched alloys.

It will be understood from FIG. 4 that $(BH)_{max}$ of 15 MGOe or more are obtained for R content being selected within a range of 28.0–65.0 wt%.

EXAMPLE 11

An alloy ingot consisting of R 40.0 wt%, B 0.9 wt%, and the balance of Fe was prepared in the similar manner as described in Example 2. From the alloy ingot, an alloy ribbon was produced by the similar method as in Example 10 using a steel quenching disk rotating a chill surface speed of 30 m/sec. The alloy ribbon has a width of about 2 mm and a thickness of about 50 μm. Crystal grains contained in the ribbon was confirmed to have an average grain size of about 0.01 μm. The ribbon was processed in the similar steps as in Example 10 to produce a magnet but using 1,020° C. for the sintering temperature. Table 7 shows the magnetic properties of the magnet.

TABLE 7

| Br (kG) | $_{I}H_{C}$ (kOe) | $(BH)_{max}$ (M.G.Oe) |
|---|---|---|
| 11.2 | 18.5 | 30.5 |

EXAMPLE 12

In a similar manner as in Example 3, an alloy ingot consisting of R 40.0 wt%, B 1.0 wt%, and the balance of Fe was prepared. The ingot was processed by the similar continuous splat-quenching method using a steel quenching disk as in Example 10 but using a chill surface speed of 5 m/sec and ribbon-like flakes was obtained each having a width of about 5 mm and a thickness of about 150 μm. Each flake was observed to contain crystal grains having an average grain size of about 0.5 μm.

The flakes were also processed in the similar steps as described in Example 10 but using 1,030° C. as the sintering temperature and a magnet was obtained which had magnetic properties as shown in Table 8.

TABLE 8

| Br (kG) | $_{I}H_{C}$ (kOe) | $(BH)_{max}$ (M.G.Oe) |
|---|---|---|
| 11.1 | 16.0 | 29.5 |

EXAMPLE 13

Using Nd of a purity factor of 97% and Dy added to the Nd by 5 at%, ferroboron, electrolytic iron, and electrolytic cobalt as starting materials, alloy ingots consisting of R 35.0 wt%, B 0.9 wt%, and the balance of $T=Fe_{1-x}Co_x$ (x=0, 0.1, 0.2, 0.3, and 0.4, respectively) were prepared in the manner as described in Example 1.

Those ingots were melted and ejected onto the chill surface of a copper quenching disk rotating at a chill surface speed of 10 m/sec in the similar manner as described in the Example 1 to form rapidly-quenched alloys each having a width of about 5 mm and a thickness of about 150 μm. Each of the resultant rapidly-quenched alloys contains fine crystal grains of an average grain size of 0.1 μm.

Those rapidly-quenched alloys were crushed and ground into powders having an average particle size of 2.5 μm, which were compacted by a pressing force of 1 ton.f/cm² in an aligning magnetic field of 20 kOe to form compacted bodies, respectively.

The compacted bodies were processed in the similar manner as described in Example 5 but using a sintering temperature of 1,060° C. to produce magnets. Magnetic properties were measured and shown in FIG. 5.

Figure 5:
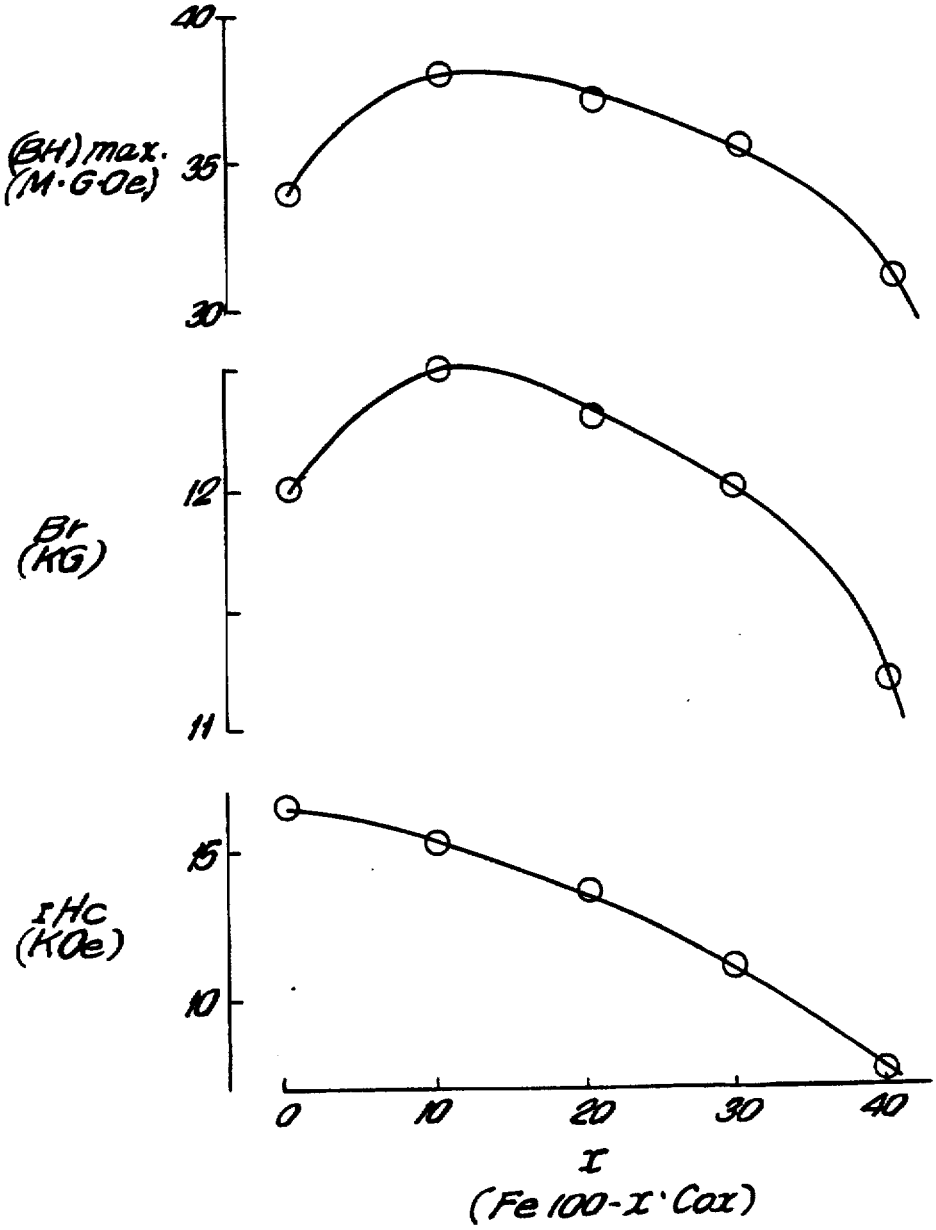
FIG. 5 is a graph showing magnetic properties of sintered magnets in Example 13 together with cobalt contents in transition metal elements.

FIG. 5 teaches us that replacement of a part of Fe by Co up to 35 at% serves to improve $(BH)_{max}$.

EXAMPLE 14

Two alloy ingots were prepared in the similar manner as described in Example 13. One of the ingots consisted of R 40.0 wt%, B 1.0 wt%, and the balance of Fe as T (transition metal), while the other one consisted of R 40.0 wt%, B 1.0 wt%, and the balance of $Fe_{90}Co_{10}$ as T (transition metals). From these ingots, rapidly-quenched alloys each having a width of about 3 mm and a thickness of about 30 μm were produced by the similar continuous splat-quenching method. Each of rapidly-quenched alloys were confirmed to contain fine crystal grains of an average grain size. Two magnets were made from these rapidly-quenched alloys, respectively, in the similar manner as described in the Example 13 but using 1,020° C. as the sintering temperature while aging being carried out for one hour.

The magnetic properties of the magnets are shown in Table 9.

TABLE 9

| T | Br (kG) | $_IH_C$ (kOe) | $(BH)_{max}$ (M.G.Oe) |
|---|---|---|---|
| Fe | 11.9 | 14.5 | 33.5 |
| $Fe_{90}Co_{10}$ | 12.4 | 13.0 | 37.5 |

It is clear from Table 9 that inclusion of Co as transition metal element T improves Br and $(BH)_{max}$.

EXAMPLE 15

In the similar way as described in Example 3, two alloy ingots were made, one of which consisted of R 40.0 wt%, B 1.1 wt%, and the balance of $Fe_{97}Al_3$, while the other consisting of R 40.0 wt%, B 1.1 wt%, and the balance of $Fe_{77}Co_{20}Al_3$. Two rapidly-quenched alloys having a width of about 5 mm and a thickness of about 100 μm were prepared from these alloy ingots in the manner as described in Example 13. Each of the rapidly-quenched alloys contains crystal grains of an average grain size of 0.05 μm. From these rapidly-quenched alloys, two magnets were produced in the similar manner as described in Example 13. The magnetic properties of the magnets are shown in Table 10.

TABLE 10

| T | Br (kG) | $_IH_C$ (kOe) | $(BH)_{max}$ (M.G.Oe) |
|---|---|---|---|
| $Fe_{97}Al_3$ | 10.8 | 15.5 | 27.5 |
| $Fe_{77}C_{20}Al_3$ | 11.1 | 13.0 | 30.0 |

Table 10 teaches us that addition of cobalt improves Br and $(BH)_{max}$.

EXAMPLE 16

An alloy ingot consisting of R 32 wt%, B 1.1 wt% and the balance of Fe was made in the similar manner as in Example 1. From the alloy ingot, a ribbon was prepared by the similar continuous splat-quenching method using a copper quenching disk at a chill moving surface speed of 10 m/sec. The ribbon had a width of about 5–10 mm and a thickness of about 50–100 μm, and contained crystal grains of average grain size of 0.3 μm.

The ribbon was crushed and ground into powder of an average particle size of 2.5 μm and then compacted into a compact body by pressing force of 2 ton.f/cm² within an aligning magnetic field of 20 kOe.

The compacted body was sintered at a temperature of 1,000°–1,120° C. in vacuum for one hour and in argon gas for another one hour. The resultant sintered body had a saturated sintered density and contained crystal grains of an average grain size of 5–30 μm dependent on the sintering temperature.

The sintered body was aged at a temperature of 650° C. in argon gas for two hours, and then magnetized by a magnetic field of 30 kOe. The magnet was subjected to measurement of the magnetic properties.

Figure 6:
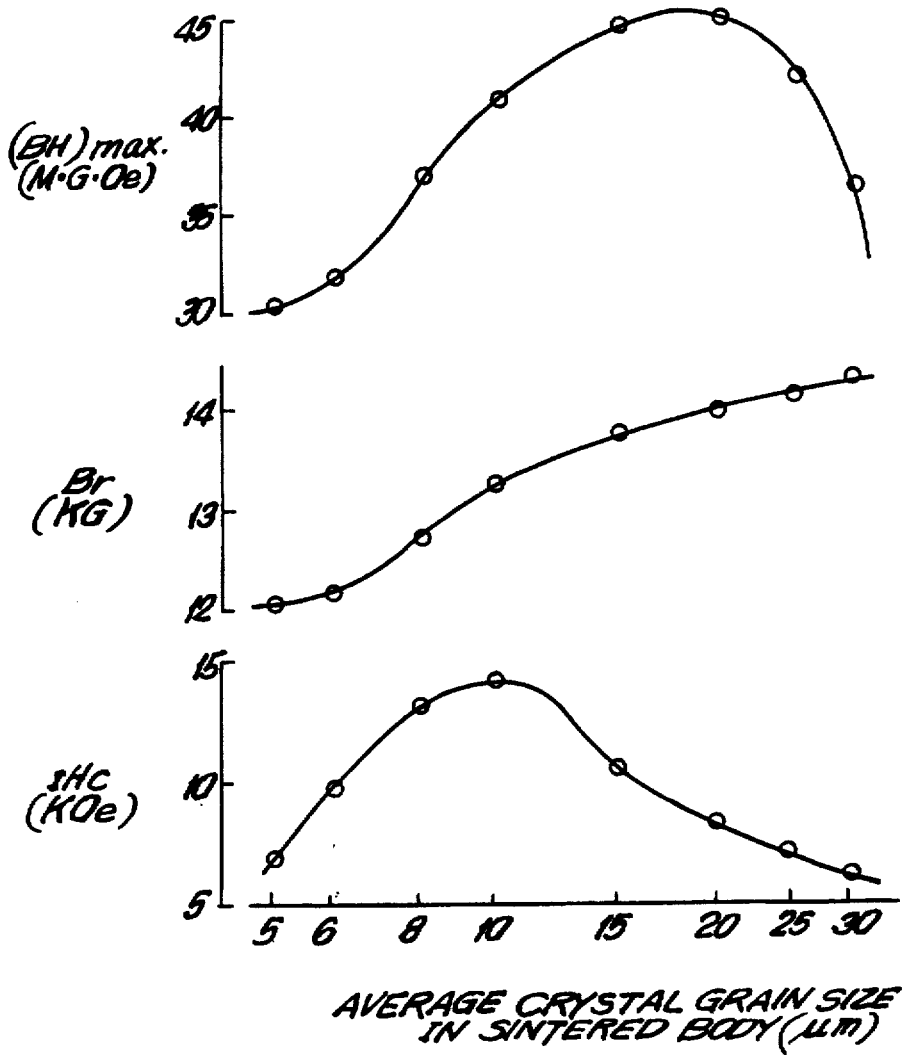
FIG. 6 is a graph showing magnetic properties of sintered magnets in Example 16 together with average grain sizes of crystals in sintered bodies.

The measured data are shown in FIG. 6 together with the average crystal grain size in the sintered body. FIG. 6 teaches us that high magnetic properties can be obtained for the average crystal grain size of 7–30 μm in the sintered body.

EXAMPLE 17

From the alloy ingot made in Example 11, an alloy ribbon was prepared by the continuous splat-quenching method similar to that in Example 16. The chill surface speed was about 15 m/sec and the obtained ribbon had a width of about 5 mm and a thickness of about 50 μm. Crystal grains in the ribbon were about 0.1 μm in the average grain size.

Two compacted bodies were formed from the powder by the similar manner as in Example 16, and were sintered at different temperatures of 980° C. and 1,050° C., respectively, and thereafter aged in the similar manner as in Example 16. Those sintered bodies had a full sintered density and grown crystal grains which were about 6 μm and 15 μm in the average grain size for the sintering temperatures of 980° C. and 1,050° C., respectively.

The sintered and aged bodies were magnetized similar to Example 16 and magnetic properties were measured. The measured data are shown in Table 11.

TABLE 11

| AVERAGE CRYSTAL GRAIN SIZE IN SINTERED BODY (μm) | Br (kG) | $_IH_C$ (kOe) | $(BH)_{max}$ (M.G.Oe) |
|---|---|---|---|
| 6 | 11.0 | 17.0 | 26.5 |
| 15 | 11.6 | 14.5 | 32.5 |

EXAMPLE 18

According to the method as shown in Example 3, an ingot consisting of R 35.0 wt%, B 1.0 wt%, and the balance of $Fe_{77}B_{20}Al_3$ was made. Then, an alloy ribbon was prepared from the ingot using a quenching disk rotating at the chill surface speed of 5 m/sec. The width and thickness of the ribbon were about 10 mm and about 200 μm, respectively, and an average grain size of crystals in the ribbon was about 0.5 μm.

Two compacted bodies were formed in the manner similar to that in Example 17 and were sintered at temperatures of 1,000° C. and 1,080° C., respectively. The resultant sintered bodies had grown crystals of average grain sizes of 6 μm and 15 μm, respectively. The sintered bodies were aged, and magnetized similar to Example 17. The magnetic properties are shown in Table 12.

TABLE 12

| AVERAGE CRYSTAL GRAIN SIZE IN SINTERED BODY (μm) | Br (kG) | $_{I}H_{C}$ (kOe) | $(BH)_{max}$ (M.G.Oe) |
|---|---|---|---|
| 6 | 11.2 | 15.5 | 30.0 |
| 15 | 12.2 | 13.0 | 35.5 |

Next, three examples will be described wherein rapidly-quenched alloy ribbon or flakes prepared by the continuous splat-quenching method are heat-treated in order to improve orientation of crystals therein.

EXAMPLE 19

In the similar manner as in Example 1, an alloy ingot consisting of R 33.0 wt%, B 1.0 wt%, and the balance of Fe, was prepared and rapidly-quenched alloys ribbon were produced by the similar continuous splat-quenching method using a quenching copper disk rotating at the chill surface speed of 10 m/sec. Each of the ribbons had a width of 5 mm and a thickness of 50 μm. It was confirmed that the ribbon had $Nd_2Fe_{14}B$ crystals of grain sizes of 1 μm or less dispersed therein with C-planes of the crystals being mainly oriented in a parallel direction of the main surface of the ribbon. In particular, the free surface farthest from the chill surface had crystals of large grain size with a high crystal orientation in comparison with the rapidly cooled surface impinging the chill surface.

Those ribbons were heat treated at 600° C., 700° C., 800° C., 900° C., and 1,000° C. for two hours, respectively, and were crushed and ground into powders, respectively, with an average particle size of about 3 μm.

Those powders were compacted into compact bodies, respectively, under a pressure of 2 ton.f/cm$^2$ within an aligning magnetic field of 25 kOe. Those compact bodies were sintered at 1,080° C. in vacuum for one hour and in argon gas in following one hour and quenched to obtain sintered bodies. The sintered bodies were aged at 620° C. for two hours, and were magnetized by application of a magnetic field of about 30 kOe. The magnetic properties of the resultant magnets are shown in FIG. 7 together with the heat-treatment temperatures.

Figure 7:
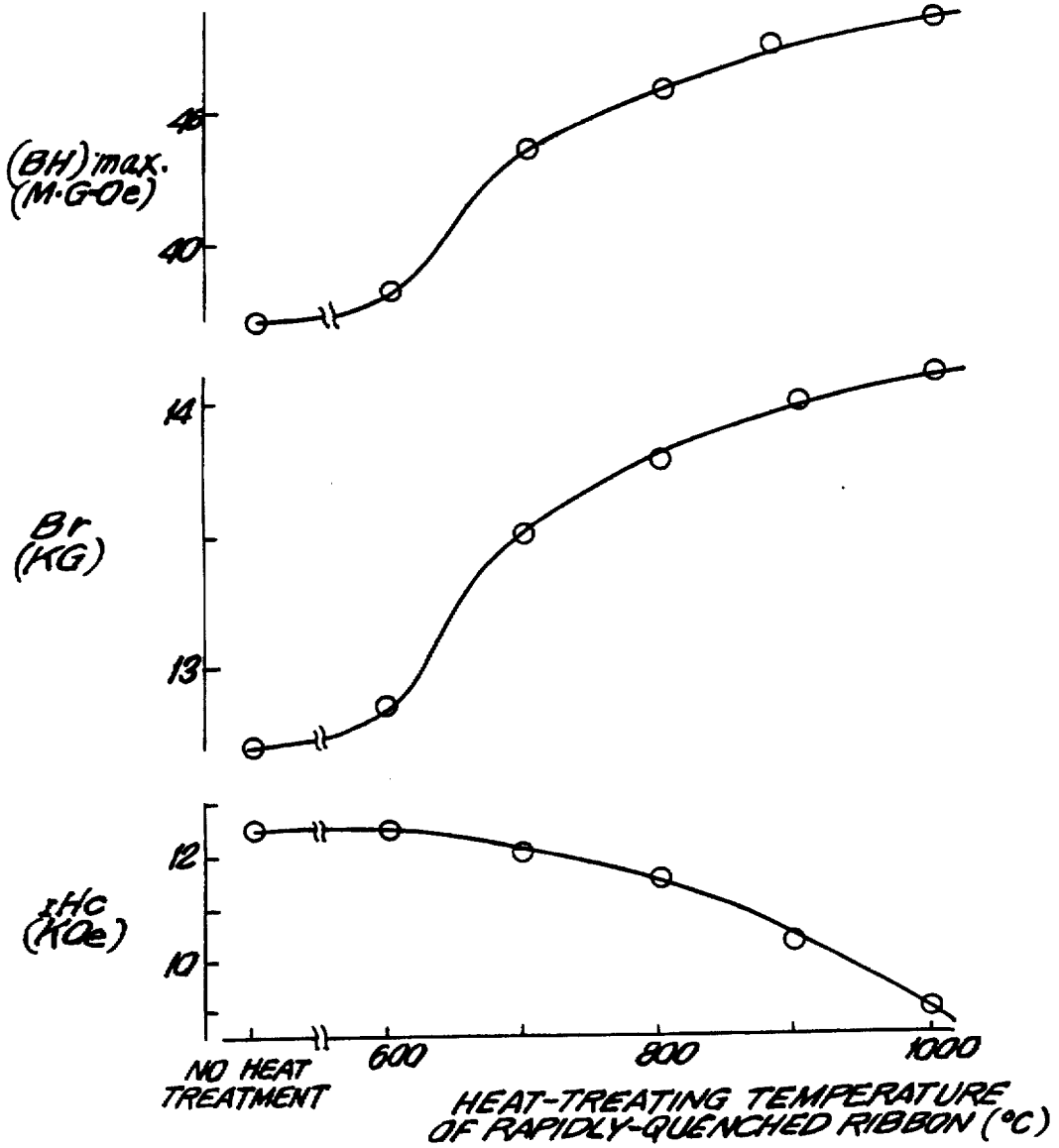
FIG. 7 is a graph showing magnetic properties of sintered magnets in Example 19 together with heat treated temperatures for rapidly-quenched alloy ribbons.

FIG. 7 teaches us that heat treatment at 650° C. or more considerably improves the Br and $(BH)_{max}$.

EXAMPLE 20

An ingot consisting of R 35.0 wt%, B 0.9 wt%, and the balance of Fe was prepared in the similar manner as described in Example 2. From the ingot, two rapidly-quenched alloy ribbons were prepared in the similar manner as in Example 19. Those ribbons contained crystals of grain sizes of 2 μm or less with crystal orientation in the parallel direction to the main surface of the ribbon.

One of the ribbons was heat treated at 800° C. in argon gas for one hour.

The heat-treated and no heat-treated ribbons were crushed and ground into respective powders, from which magnets were produced, respectively, in the similar manner as described in Example 19. The magnetic properties of the resultant magnets are demonstrated in Table 13.

TABLE 13

| HEAT TREATMENT OF RIBBON | Br (kG) | $_{I}H_{C}$ (kOe) | $(BH)_{max}$ (M.G.Oe) |
|---|---|---|---|
| 800° C. | 12.5 | 15.5 | 37.5 |
| NO | 11.6 | 16.0 | 31.5 |

It will be understood from Table 13 that the heat treatment improves the magnetic properties.

EXAMPLE 21

An alloy ingot consisting of R 40.0 wt%, B 1.1 wt%, and the balance of $Fe_{77}Co_{20}Al_3$ was prepared in the similar manner as described in Example 3. From the ingot, two rapidly-quenched ribbons were prepared by the continuous splat-quenching method as described in Example 19. Those ribbons had $Nd_2(FeCoAl)_{14}B$ crystals of grain sizes of 3 μm or less with C-planes mainly oriented in the parallel direction to the main surface of the ribbon.

One of the ribbons was heat treated at 800° C. in argon gas for one hour.

The heat treated and no heat treated ribbons were crushed and ground into powders and were formed into sintered magnets, respectively, in the similar manner as described in Example 19, but using the sintering temperature of 1,050° C.

The magnetic properties of the resultant magnets are shown in Table 14. Table 14 also teaches us that the heat treatment considerably improves the magnetic properties.

TABLE 14

| HEAT TREATMENT OF RIBBON | Br (kG) | $_{I}H_{C}$ (kOe) | $(BH)_{max}$ (M.G.Oe) |
|---|---|---|---|
| 800° C. | 11.6 | 14.5 | 32.5 |
| NO | 10.8 | 15.0 | 27.0 |

Next, description will be made as to an example wherein a magnetic field is applied to the rapidly-quenched alloy during being cooled. Use of the rapidly-quenched alloy powder considerably improves a sintered magnet.

EXAMPLE 22

In the similar manner as described in Example 1, an alloy ingot was made which consisted of R 34.0 wt%, B 1,0 wt%, and the balance of Fe. From the ingot, two rapidly-quenched alloy ribbons having a width of about 5 mm and a thickness of about 50 μm were prepared by the similar continuous splat-quenching method using a copper quenching disk rotating at the chill surface speed of about 10 m/sec.

One of the ribbon was exposed in a magnetic field during being rapidly cooled.

Figure 8:
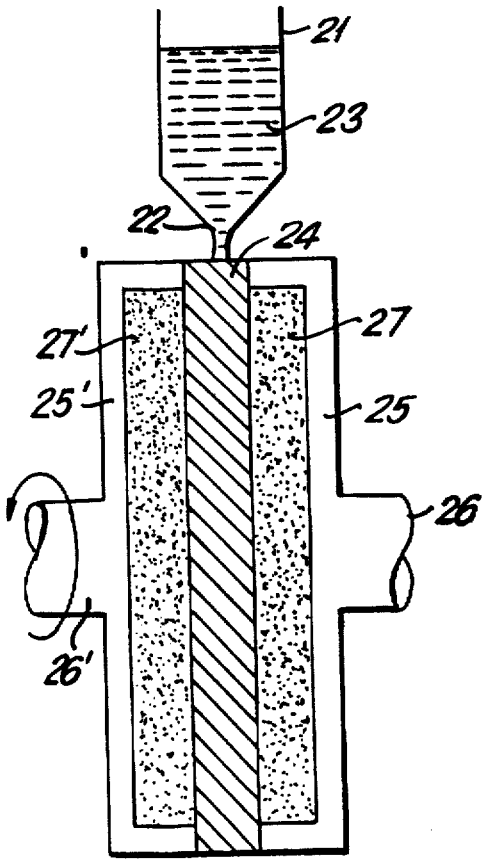
FIG. 8 is a sectional view of a device for preparing a rapidly-quenched ribbon which is used in Example 22.

FIG. 8 shows a device used for preparing the ribbon with application of the magnetic field. The device comprises a melting tube 21 made of, for example, quartz, in which the alloy ingot is melted in a molten state. The melting tube 21 has a small orifice 22 through which the molten alloy 23 is ejected onto a quenching disk 24 of iron. On the opposite sides of the quenching disk 24, two hollow disk-shaped cases 25 and 25' are mounted which are made of non-magnetic steel and have rotating shafts 26 and 26' on a common central axis thereof. The cases 25 and 25' fixedly contain disk-shaped permanent magnets 27 and 27' which are magnetized in a thickness direction and have the same magnetic pole surfaces adjacent to the opposite surfaces of the quenching disk, respectively. Accordingly, the flux from the both magnets 27 and 27' radially flows at the outer peripheral surface of the iron quenching disk 24.

In this Example, for each magnets 27 and 27', a samarium cobalt magnet of a disk shape was used which had a diameter of 20 cm and a thickness of 2.5 cm with a surface flux density of 1 kGauss. An iron disk having a diameter of 21 cm and a thickness of 2.0 cm was used for the quenching disk 24. At the outer peripheral surface, a magnetic field was observed about 3 kOe.

Rotating the shafts 26 and 26' together so that the outer peripheral surface of the quenching disk 24 moves at a speed of about 10 m/sec, the molten alloy 23 was ejected through the orifice 22 onto the outer peripheral surface of the quenching disk 24 and the ribbon was produced. Accordingly, the ribbon was exposed in the radial magnetic field on the disk 24 so that the magnetic field was applied to the ribbon in the thickness direction during the ribbon being cooled.

While, the other ribbon was prepared by the device shown in FIG. 8 but the magnets 27 and 27' were replaced by non-magnetic disks. Therefore, the other ribbon was not applied with any magnetic field.

Those ribbons were observed by the X-ray diffraction microanalysis to have fine crystal grains of several micron meters or less. The ribbon applied with the magnetic field has many crystals of C-plane oriented in the parallel direction to the main surface of the ribbon in comparison with the other ribbon applied with no magnetic field.

Those ribbons were crushed and ground into powders having an average particle size of 2.5 μm, respectively, and then compacted into compact bodies, respectively, under a pressure of 1 ton.f/cm$^2$ within an aligning magnetic field of 20 kOe.

Those compacted bodies were sintered at a temperature of 1,060° C. in vacuum for one hour and in argon gas for next succeeding one hour, and were quenched. The resultant sintered bodies were aged at 650° C. in argon gas for one hour and thereafter were magnetized by application of a magnetic field of 30 kOe.

The magnetic field of the resultant magnets are shown in Table 15.

TABLE 15

| MAGNETIC FIELD DURING RAPIDLY QUENCHING | Br (kG) | $_{I}H_{C}$ (kOe) | $(BH)_{max}$ (M.G.Oe) |
|---|---|---|---|
| APPLIED | 11.2 | 10.0 | 29.0 |
| NOT APPLIED | 11.7 | 10.5 | 33.0 |

It will be understood from Table 15 that application of the magnetic field considerably improves the magnetic properties.

Now, description will be made to examples wherein rapidly-quenched alloy ribbons and/or flakes are prepared with uniform orientation of crystals is improved so that sintered magnets can be obtained improved magnetic properties.

Figure 9:
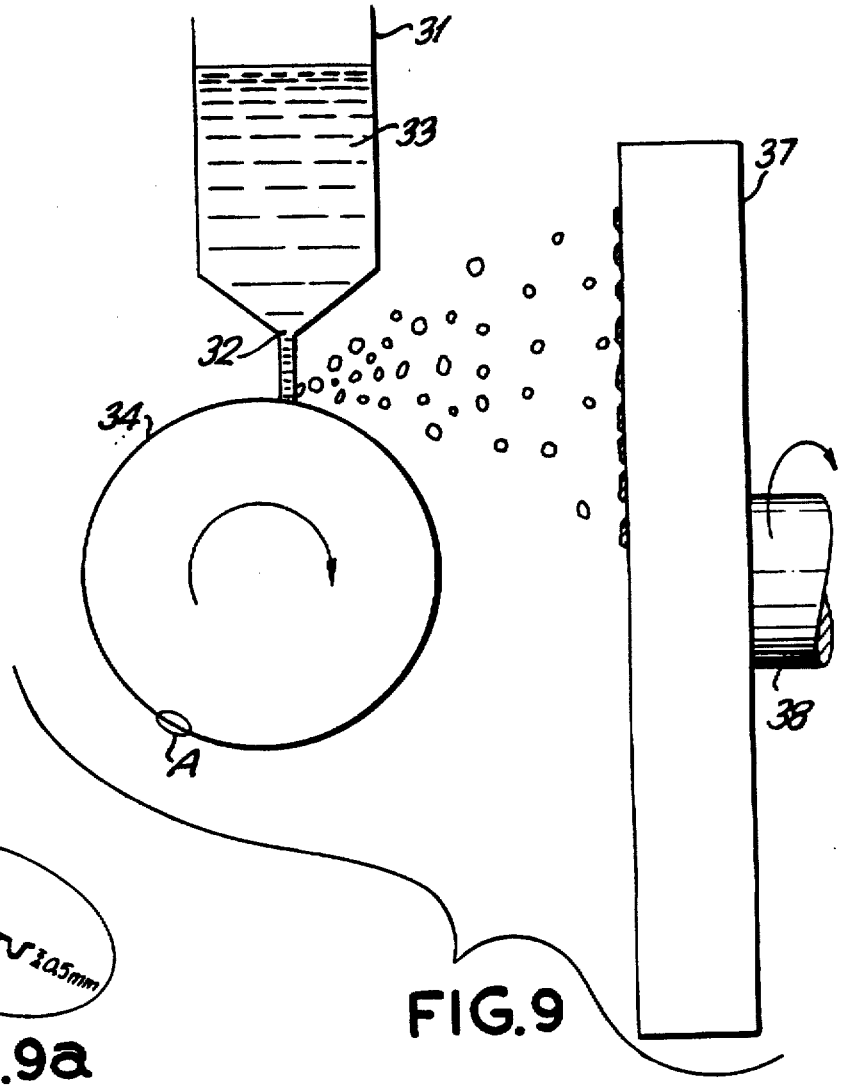
FIG. 9 is a side view of a device for preparing rapidly-quenched flakes which is used in Examples 23–25.

Referring to FIG. 9, a device is shown for preparing the rapidly-quenched alloy ribbons an/or flakes with the improved uniform orientation of crystals.

The device comprises a melting tube 31 of, for example, quartz having a small orifice 32. In the melting tube 31, an alloy 33 is melted. A quenching disk 34 is disposed under the orifice 32 so that the molten alloy 33 is ejected through the orifice 32 onto a chill surface of the quenching disk 34 which is rotated at a predetermined speed.

Figure 9A:
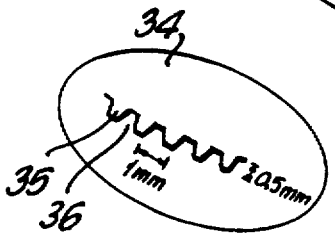
FIG. 9*a* is an enlarged view of a part in a circle A in FIG. 9.

The chill surface of the quenching disk 34 is formed with a plurality of projections 35 defining grooves 36 between adjacent two projections 35 as shown at an enlarged sectional view in FIG. 9*a*. In the following Examples, projections 35 were formed at an repetition interval of 1 mm with a radial size of 0.5 mm.

A circular cooling plate 37 with a rotating shaft 38 is disposed at a side of the quenching disk 34 to have a main surface facing the chill surface of the quenching disk 34.

The molten alloy is ejected onto the chill surface of the quenching disk 34 and sprayed by the plurality of projections 35 as atomized granules onto the main surface of the circular cooling plate 37. Each granule impinges onto the main surface and is deformed into a flat piece which is cooled to form a rapidly-quenched thin ribbon-like flakes.

EXAMPLE 23

In the similar manner as described in Example 1, an ingot was prepared which consisted of R 32.0 wt%, B 1.0 wt%, and the balance of Fe. From the ingot, rapidly-quenched alloy ribbons were prepared in the similar continuous splat-quenching method as in Example 1. In the case, the chill surface moving speed was changed within a range over about 2–80 m/sec so that the ribbons had widths of about 0.5–15 mm and thickness sizes of 10, 20, 50, 100, 200, 500, and 1,000 μm, respectively.

On the other hand, rapidly-quenched alloy flakes were prepared from the ingot using the device as shown in FIG. 9. A plurality of lots of flakes were prepared by changing the chill surface speed within a range over about 2–100 m/sec and therefore, resultant flakes have different widths 0.5–10 mm and thickness sizes of about 7–1,000 μm in dependence on the different chill surface speeds.

The distribution of grain sizes and the orientation of crystals in those ribbons were observed similar to those ribbons as in Example 4. Further, it was confirmed that uniform crystal orientation was improved in flakes with thickness sizes of 500 μm or less, in particular, 7–50 μm, by spraying in comparison with the continuous splat-quenching method.

Those ribbons and lots of flakes were crushed and ground into respective powders of an average particle size of 3 μm and then compacted into respective compact bodies by a pressure of 2 ton.f/cm$^2$ within an aligning magnetic field of 20 kOe.

Those compacted bodies were sintered in the similar condition as in Example 4 and were aged at a temperature of 650° C. for one hour. Thereafter, the sintered bodies were applied with a magnetic field of 30 kOe to form magnets.

Figure 10:
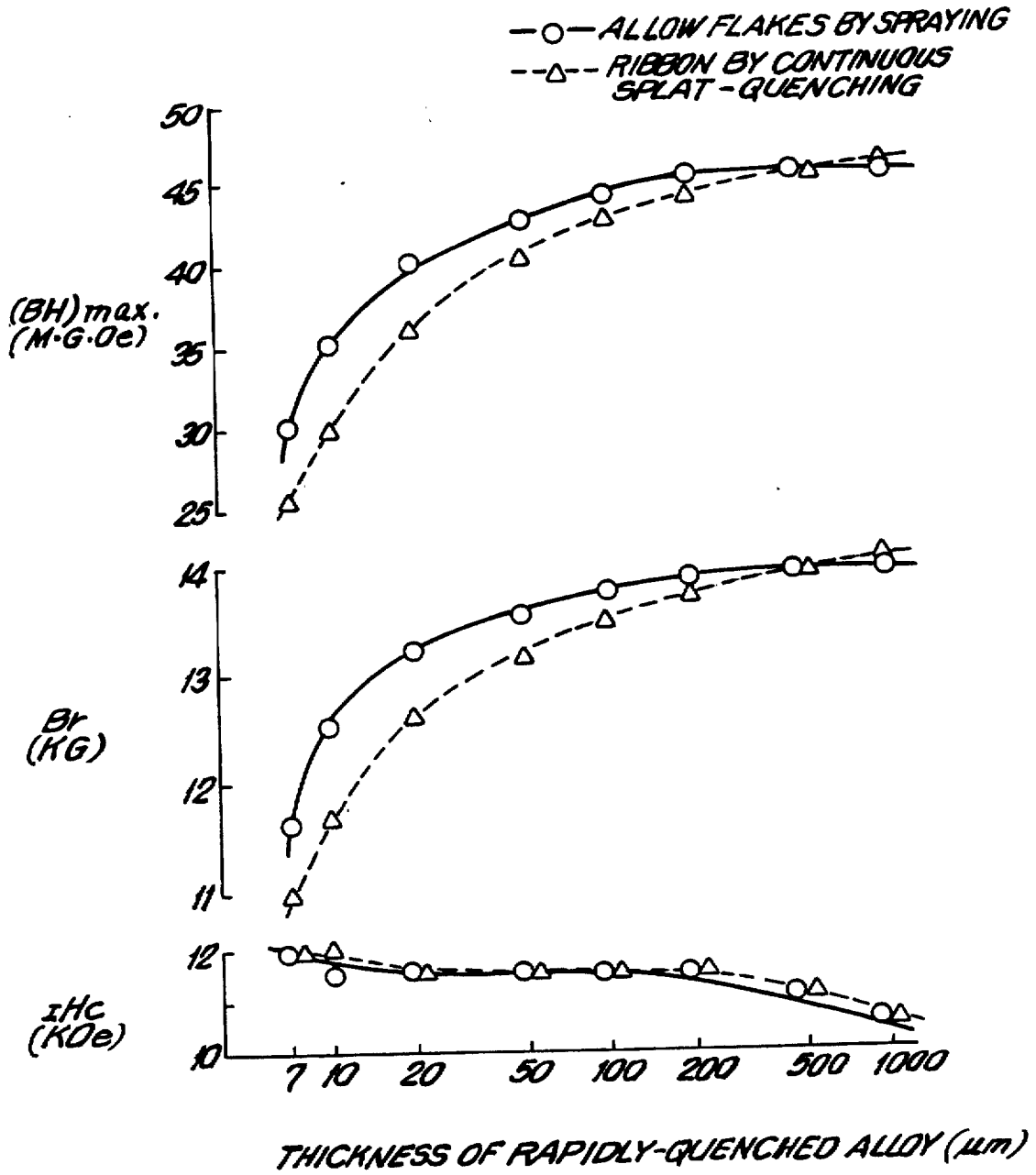
FIG. 10 is a graph showing magnetic properties of sintered magnets in Example 23 together with thickness of rapidly-quenched alloys.

The magnetic properties of the resultant magnets are shown in FIG. 10 together with the thickness sizes of the flakes made by spraying and ribbons by continuous splat-quenching method.

It will be noted that the magnets using flakes made by spraying have improved magnetic properties in comparison with the magnets made from the continuous splat-quenched ribbons for the thickness sizes of 500 μm or less. Further, it is noted that use of the flakes of 7 μm or more provides a considerably excellent Br and $(BH)_{max}$.

EXAMPLE 24

From the ingot prepared in Example 6, a lot of generally circular flakes were prepared by the use of the device as shown in FIG. 9. Each flake had a thickness of 15 μm and a diameter of 1 mm, and contained crystals having grain sizes of about 1 μm or less.

From the flakes, a magnet was prepared in the similar manner as described in Example 6. The magnetic properties of the resultant magnet are shown in Table 16 together with those of the magnet made from ribbon having 15 μm thickness in Example 6.

TABLE 16

| CHILL SURFACE | Br (kG) | $_{I}H_{C}$ (kOe) | $(BH)_{max}$ (M.G.Oe) |
|---|---|---|---|
| SMOOTH | 11.4 | 15.5 | 29.0 |
| GROOVES FORMED | 12.0 | 15.5 | 33.5 |

It is noted that the present example has a considerably improved magnetic properties comparing with Example 6.

EXAMPLE 25

Using the ingot prepared in Example 8, a lot of flakes each having a thickness of 15 μm and a diameter of 1 mm were prepared in the similar manner as in Example 24. From the flakes, a magnet was produced in the similar manner as described in Example 8.

The magnetic properties of the resultant magnet are shown in Table 17 together with those of the sample made from 15 μm ribbon in Example 8. The present example clearly has an improved magnetic properties.

TABLE 17

| CHILL SURFACE | Br (kG) | $_{I}H_{C}$ (kOe) | $(BH)_{max}$ (M.G.Oe) |
|---|---|---|---|
| SMOOTH | 10.7 | 14.5 | 26.5 |
| GROOVES FORMED | 11.4 | 14.5 | 30.5 |

Next, four examples will be described wherein a rapidly-quenched alloy powder is prepared by another method in order to provide improved magnetic properties.

Figure 11:
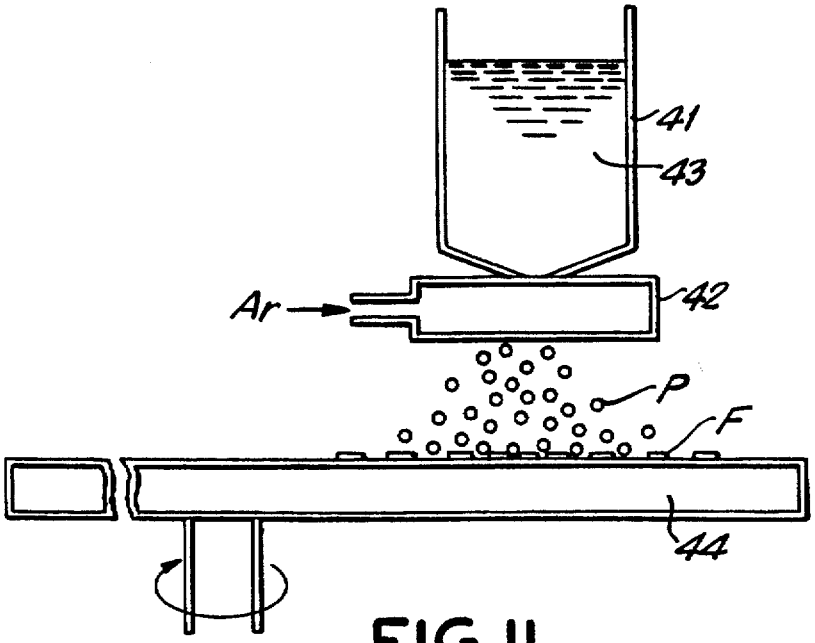
FIG. 11 is a sectional view of a device for preparing rapidly-quenched flakes which is used in examples 26 to 29.

Referring to FIG. 11, the method will be described. A device shown in FIG. 11 comprises a melting tube 41 of quartz and a spray nozzle 42 mounted at a lower portion of the melting tube 41. An alloy is melted in the melting tube 41 in a molten state. The molten alloy 43 is sprayed through the spray nozzle 42 in an atomized particles P by application of compressed argon gas Ar into the spraying nozzle 42. This method is well known in the prior art as an atomizing method for preparing an amorphous alloy wherein the atomized particles are cooled in circular small balls or granules. In the device as shown, a cooling plate 44 of such as copper is disposed under the nozzle 42 and is rotated. The atomized particles P impinge onto the main surface of the cooling plate 44 and deformed and cooled into small flat flakes F.

EXAMPLE 26

An alloy ingot consisting of R 30.0 wt%, B 1.0 wt%, and the balance of Fe was prepared using the similar starting materials and a similar melting method as in Example 1. The ingot was formed with a thickness of about 10 mm by the use of a mould having a water cooling system.

A lot of granules or small balls were prepared from the alloy ingot by the known atomizing method. Each of the granules had a particle size of about 0.2 mm.

While, a lot of flakes were also prepared by the use of the device as shown in FIG. 11, each having a diameter of about 0.3 mm and a thickness of about 100 μm.

Figure 12A:
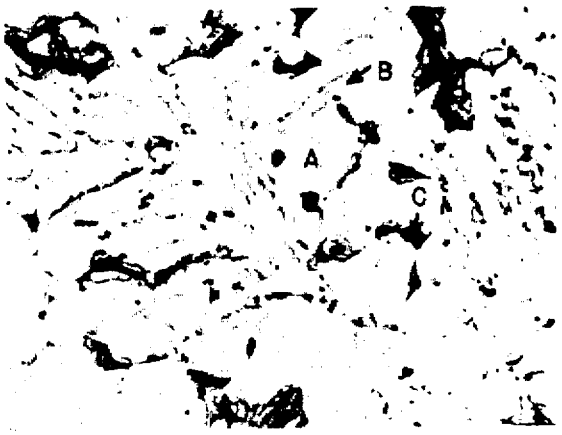
FIGS. 12*a*, 12*b*, and 12*c* show microstructures of an ingot, a granule, and a flake prepared in Example 26.
Figure 12B:
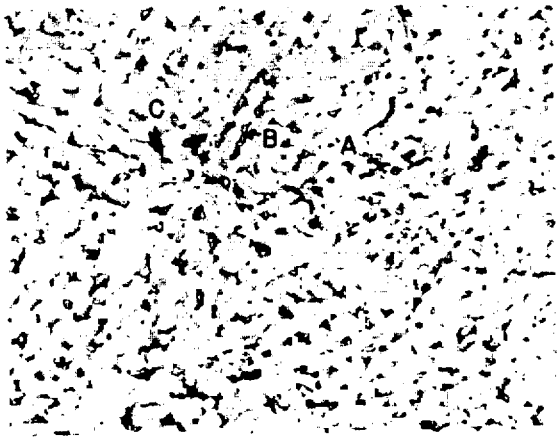
Figure 12C:
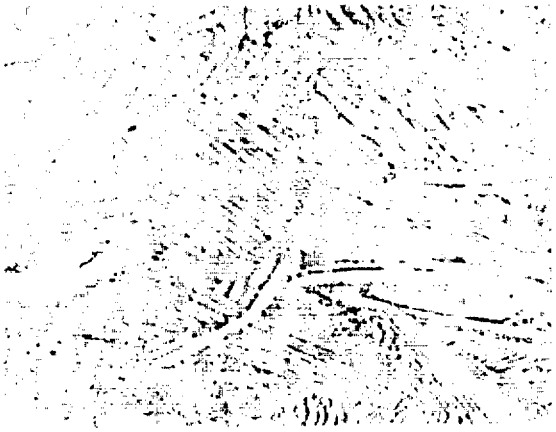

Microstructures of the ingot alloy, the granular alloy and the flaky alloy are shown in FIGS. 12*a*, 12*b*, and 12*c*, respectively.

Referring to FIG. 12*a*, the ingot comprises predominant phases (shown in white, for example, at A in the figure) of large grown crystal grains of $Nd_2Fe_{14}B$, iron grains phases (shown by small white areas, for example, at B in the figure) precipitated in the predominant phase, and Nd rich crystal phases (shown in black, for example, at C in the figure) dispersed between the predominant phases.

Referring to FIG. 12*b*, the granule comprises a predominant phases (shown by white areas, for example, at A in the figure) of $Nd_2Fe_{14}B$ crystals having grain sizes of about 5 μm, a small amount of iron phases (shown by small white areas, for example, at B in the figure) dispersed in the predominant phases, and Nd rich phases (shown in black, for example, at C in the figure) dispersed between the predominant phases.

Referring to FIG. 12*c*, the flake comprises predominant phases of needle-like crystals of $Nd_2Fe_{14}B$ and Nd rich phases at interfaces of the crystals. The C-planes of the crystals are generally oriented in a direction perpendicular to the main surface of the flake.

The ingot, the lot of granules, and the lot of flakes were crushed and ground into respective powders having an average particle size of about 3.0 μm.

Each powder was compressed into six compacted bodies by a pressing force of 2 ton.f/cm$^2$ within an aligning magnetic field of 25 kOe. These six compacted bodies were sintered at 1,000° C., 1020° C., 1,040° C., 1,060° C., 1080° C., and 1,100° C., respectively, in vacuum for beginning one hour and for following one hour, thereafter, quenched. The resultant six sintered bodies were aged at a temperature of 650° C. for five hours and magnetized by application of a magnetic field of about 30 kOe.

Figure 13:
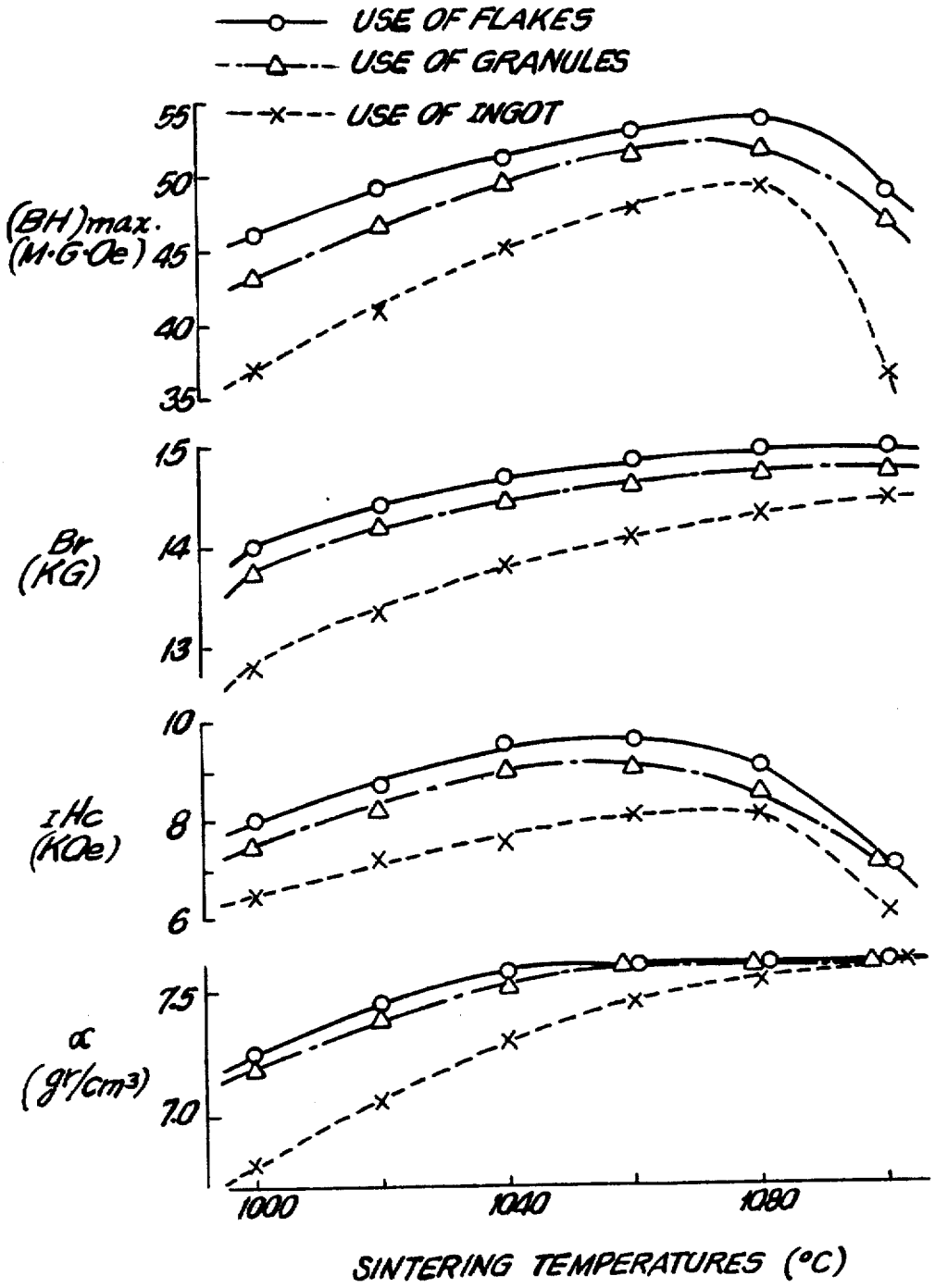
FIG. 13 is a graph showing magnetic properties of sintered magnets in Example 26 together with sintering temperatures.

The magnetic properties of the resultant magnets are shown in FIG. 13 in connection with different production methods of alloy powders together with different sintering temperatures. It will be understood from FIG. 13 that magnets made from the flake powder are superior in the magnetic properties to magnets made from the other powders although the magnets made from the granule powder also have better properties than the magnets made from the ingot powder.

EXAMPLE 27

An ingot consisting of R 30.5 wt%, B 1.0 wt%, and the balance of Fe was prepared by the similar manner as described in Example 1.

A lot of granules having particle sizes of about 50 μm and a lot of flakes having diameters of about 50 μm and thickness of about 30 μm were prepared from the ingot by the known gas atomizing method and the method using the device as shown in FIG. 11, respectively. These granules and flakes comprised a microstructure of $Ne_2Fe_{14}B$ crystal grains of sizes of 3 μm or less and Nd rich phases at interfaces between the crystals. Further, it was confirmed by X-ray diffraction microanalysis that C-planes of the crystals in each flake were almost uniformly oriented in the direction parallel to the main surface of the flake.

Those granules and flakes were crushed and ground into powders of an average particle size of 4 μm, respectively, and were compacted to form compact bodies, respectively, in the similar manner as described in Example 26.

The resultant compacted bodies were sintered at 1,080° C. in vacuum for one hour and in argon gas for succeeding one hour and quenched. The sintered bodies were aged at 650° C. for five hours and then magnetized in the magnetic field of 25 kOe.

The magnetic properties of those resultant magnets are shown in Table 18. Although the magnets made from the granular powder have an excellent magnetic properties, the other magnets made from the flakes are superior to them.

TABLE 18

| RAPIDLY-QUENCHED ALLOY | Br (kG) | $_{I}H_{C}$ (kOe) | $(BH)_{max}$ (M.G.Oe) |
|---|---|---|---|
| GRANULAR POWDER | 13.6 | 10.0 | 41.5 |
| DISC-LIKE FLAKES | 14.3 | 10.5 | 48.5 |

EXAMPLE 28

An ingot was prepared in the similar manner as described in Example 2. The ingot comprised R 31.5 wt%, B 0.9 wt%, and the balance of Fe.

From the ingot, a lot of granules having diameter about 0.1 mm and a lot of flakes each having a diameter of about 0.3 mm and a thickness of about 50 μm in the manner similar to Example 27.

The granules and the flakes were crushed and ground into powders having an average particle size of about 3.5 μm and were compacted into compact bodies, respectively, in the similar manner as in Example 26. Those compact bodies were similarly sintered at 1,060° C. and were quenched. The resultant sintered bodies were aged at 650° C. for three hours and thereafter were magnetized in a magnetic field of 25 kOe.

The magnetic properties of resultant magnets are shown in Table 19.

TABLE 19

| RAPIDLY-QUENCHED ALLOY | Br (kG) | $_{I}H_{C}$ (kOe) | $(BH)_{max}$ (M.G.Oe) |
|---|---|---|---|
| GRANULAR POWDER | 13.0 | 16.0 | 40.0 |
| DISK-LIKE FLAKES | 13.5 | 16.5 | 44.0 |

EXAMPLE 29

An ingot consisting of R 32.0 wt%, B 1.1 wt%, and the balance of $Fe_{77}Co_{20}A_{13}$ was prepared in the similar manner as described in Example 3.

A lot of granules having a diameter of about 0.1 mm and a lot of flakes each having a diameter of about 0.3 mm and a thickness of about 50 μm were prepared in the similar manner as described in Example 28.

Magnets were produced from those granules and flakes, respectively, in the similar manner as described in Example 28. The magnetic properties of the resultant magnets are shown in Table 20.

TABLE 20

| RAPIDLY-QUENCHED ALLOY | Br (kG) | $_{I}H_{C}$ (kOe) | $(BH)_{max}$ (M.G.Oe) |
|---|---|---|---|
| GRANULAR POWDER | 12.8 | 13.0 | 37.0 |
| DISC-LIKE FLAKES | 13.3 | 13.5 | 42.0 |

Next, several examples will be described wherein rapidly-quenched alloy ribbon is prepared with crystals having improved uniform orientation and grain size and therefore can provide sintered magnets with further improved magnetic properties.

Figure 14:
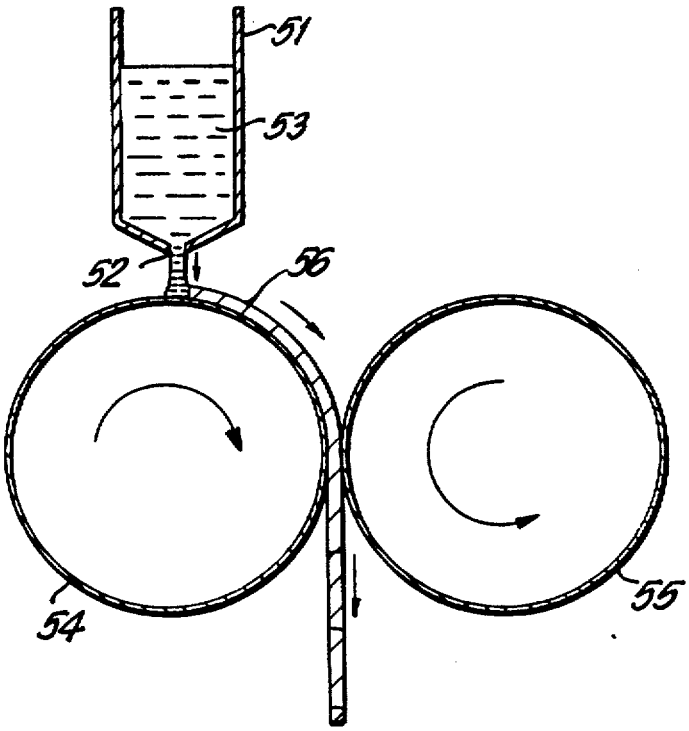
FIG. 14 is a sectional view of a device for preparing a rapidly-quenched alloy ribbon which is used in Examples 30 to 32.

Referring to FIG. 14, a device for preparing the improved rapidly-quenched alloy ribbon comprises a melting tube 51 of, for example, quartz having a small orifice 52 on its bottom portion. An alloy is melted in the melting tube 51 in the molten state shown at 53. Under the orifice 52, a quenching disk 54 is disposed so that the molten alloy 53 is ejected onto an outer peripheral chill surface of the quenching disk 54 through the orifice 52. Another cooling disk 55 is disposed adjacent to the quenching disk 54 so that it has an outer peripheral surface spaced by a small gap from the chill surface. Both of the disks 54 and 55 rotate in opposite direction to each other but with a rotating speed.

The molten alloy ejected from the orifice 52 onto the chill surface of the disk 54 is formed into a ribbon form and thereafter a free surface of the ribbon 56 comes into contact with the outer surface of disk 55. Accordingly,- the free surface of the ribbon 56 is also rapidly quenched by the disk 55 but delayed from the opposite surface impinging the disk 54.

In the prior art, a method using two quenching disks is well known for forming amorphous alloy ribbon (which will be referred to as "a double chill disk method" hereinafter) wherein, referring to FIG. 14, the molten alloy 53 is directly ejected into a small gap between two disks 54 and 55 so that the the molten alloy is rapidly quenched from the both sides at the same time. In this connection, the continuous splat-quenching method using a single quenching disk as disclosed in References 2, 3, and 5 will be referred to as "a single chill disk method".

The device shown in FIG. 14 uses two disks similar to the double disk method but the molten alloy comes into contact with the two disks at not the same time but different times. Therefore, the method using the device shown in FIG. 14 will be referred to as "a modified double chill disk method".

EXAMPLE 30

An ingot consisting of R 32.0 wt%, B 1.0 wt%, and the balance of Fe was prepared by the similar method as described in Example 1.

An alloy ribbon was made from the ingot by the use of the device shown in FIG. 14 with steel disks 54 and 55 rotating at a surface moving speed of 10 m/sec. This ribbon will be referred to as ribbon A. Ribbon A had a width of about 10 mm and a thickness of about 100 μm.

For comparison, another ribbons B and C were prepared by the single chill disk and the double chill disk methods, respectively, with the same surface moving speed.

It was confirmed by the X-ray diffraction microanalysis that those ribbons A, B, and C contained $Nd_2Fe_{14}B$ crystals dispersed in the ribbons. In ribbon A, a surface cooled by the first disk 54 shows very fine crystals of grain sizes from submicron orders to 3 μm which are not almost oriented while the other surface cooled by the other disk 55 and intermediate region between the both surfaces showing crystals of grain sizes from 1 μm to 3 μm and almost oriented uniformly.

In ribbon B, a surface cooled by the disk shows very fine crystals of grain sizes from submicron orders to 3 μm which are not almost oriented while the other free surface and an intermediate region between both surfaces having large crystals of 1–5 μm such as needle like crystals which are almost oriented uniformly.

In ribbon C, the opposite surfaces shows very fine crystals of grain sizes from submicron orders to 3 μm which are not almost oriented uniformly while the intermediate region between both surfaces having crystals which are slightly oriented uniformly.

Ribbons A, B, and C were crushed and ground into powders having an average particle size of about 3 μm, respectively and then, compacted into compact bodies, respectively, by a pressing force of 2 ton.f/cm$^2$ within an aligning magnetic field of 20 kOe.

Those compacted bodies were sintered at 1,000° C. in vacuum for one hour and in argon gas for succeeding one hour and quenched. The resultant sintered bodies were magnetized by application of a magnetic field of about 30 kOe to form magnets.

The magnetic properties of those magnets are shown in Table 21.

TABLE 21

| RAPIDLY QUENCHING METHOD | d (gr/cm$^3$) | Br (kG) | $_IH_C$ (kOe) | $(BH)_{max}$ (M.G.Oe) |
|---|---|---|---|---|
| SINGLE CHILL DISK | 7.20 | 12.5 | 11.0 | 36.0 |
| DOUBLE CHILL DISK | 7.55 | 11.8 | 12.0 | 30.5 |
| MODIFIED DOUBLE CHILL DISK | 7.55 | 13.1 | 13.5 | 40.0 |

From Table 21, it will be noted that the magnet made from ribbon B has an improved magnetic properties in comparison with magnet made from ribbon C but the magnet made from ribbon A is superior to the magnets made from the ribbons B and C.

EXAMPLE 31

From an ingot prepared in Example 30, rapidly-quenched alloy ribbons A and B were prepared by the modified double chill disk and the double chill disk methods, respectively. A disk surface moving speed was about 2 m/sec and therefore each ribbon A and B had a width of about 10 mm and a thickness of about 500 μm.

Magnets were prepared from those ribbons A and B in the similar manner as described in Example 30 but using the sintering temperature of 1,050° C.

The magnetic properties of the resultant magnets are shown in Table 22.

TABLE 22

| RAPIDLY QUENCHING METHOD | d (gr/cm$^3$) | Br (kG) | $_IH_C$ (kOe) | $(BH)_{max}$ (M.G.Oe) |
|---|---|---|---|---|
| DOUBLE CHILL DISK | 7.58 | 12.9 | 11.5 | 37.5 |
| MODIFIED DOUBLE CHILL DISK | 7.58 | 14.0 | 11.5 | 46.0 |

In ribbon B, crystals are grown comparatively large and are oriented comparatively uniform. Therefore, the magnetic properties are improved in comparison with the magnets made from ribbon C prepared by the double chill disk method in Example 30. However, the magnetic properties of magnets made from ribbon A is superior to it.

EXAMPLE 32

An ingot consisting of R 35.0 wt%, B 0.9 wt%, and the balance of Fe was prepared in the similar manner as described in Example 2.

From the ingot, ribbons A and B were prepared by the modified double chill disk and the double chill disk methods and then magnets were produced from ribbons A and B, respectively, in the similar manner as described in Example 31. The magnetic properties of the resultant magnets are shown in Table 23.

TABLE 23

| RAPIDLY QUENCHING METHOD | Br (kG) | $_IH_C$ (kOe) | $(BH)_{max}$ (M.G.Oe) |
|---|---|---|---|
| DOUBLE CHILL DISK | 11.7 | 17.5 | 30.0 |
| MODIFIED DOUBLE CHILL DISK | 12.4 | 17.0 | 36.5 |

EXAMPLE 33

In the method as described in Example 3, an ingot was prepared which consisted of R 40.0 wt%, B 1.1 wt%, and the balance of $Fe_{77}Co_{20}Al_3$.

Ribbons A and B were prepared from the ingot by the modified double chill disk method and the double chill disk method and then magents were produced from ribbons A and B, respectively, in the similar manner as described in Example 31.

The magnetic properties of the magnets are shown in Table 24.

TABLE 24

| RAPIDLY QUENCHING METHOD | Br (kG) | $_{I}H_{C}$ (kOe) | $(BH)_{max}$ (M.G.Oe) |
|---|---|---|---|
| DOUBLE CHILL DISK | 10.8 | 15.0 | 27.0 |
| MODIFIED DOUBLE CHILL DISK | 11.6 | 14.5 | 32.5 |

The present invention has been described in connection with examples wherein Nd is mainly used for rare earth metal elements, but the present invention is applied to magnets using other rare earth metal elements for R. Further, other transition metal elements than Co and Ni can be used together with Fe.

What is claimed is:

1. In a method for producing a rare earth-transition metal-boron (R-T-B) anisotropic sintered magnet by preparing an R-T-B alloy powder containing $R_2T_{14}B$ crystal grains, subjecting the powder to a magnetic field, compacting the powder into a compact body of a desired shape, and inserting the compact body at a sintering temperature thereby to produce the sintered magnet, the improvement wherein said R-T-B alloy powder is a rapidly quenched alloy powder produced by:

preparing said R-T-B alloy in a molten state;

rapidly quenching said molten R-T-B alloy to form ribbons and/or ribbon-like flakes characterized by a main surface, each ribbon and/or flake having a predetermined thickness and containing said crystal grains uniformly dispersed in said ribbon and/or flake, said crystal grains having an average grain size less than said predetermined thickness and oriented in a direction parallel to the main surface of said ribbons or flakes; and crushing and grinding said ribbons and/or flakes into a powder of an average particle size of a value less than said predetermined thickness but larger than said average grain size, each particle of said powder containing said crystal grains extending in said parallel direction, to thereby enable said powder to be magnetically aligned in said magnetic field.

2. A method as claimed in claim 1, wherein each of said ribbons and/or flakes has a thickness of 20–500 μm, said crystal grains having an average grain size of 10 μm or less.

3. A method as claimed in claim 2, wherein each of said ribbons and/or flakes has a thickness of 50–500 μm.

4. A method as claimed in claim 2, wherein said crystal grains has an average grain size of 1–10 μm.

5. A method as claimed in claim 2, wherein said crushed and ground powder has an average particle size of 0.3–15 μm.

6. A method as claimed in claim 5, wherein said crushed and ground powder has an average particle size of 1.5–7 μm.

7. A method as claimed in claim 5, wherein said sintering is carried out so that said crystal grains are grown to have a grain size of 7–30 μm.

8. A method as claimed in claim 1, wherein said R-T-B alloy powder consists, by weight, of R 28.0–65.0%, and the balance of T and B.

9. A method as claimed in claim 8, wherein said R-T-B alloy powder consists, by weight, of R 30–40%, B 0.8–1.3%, and the balance of T.

10. A method as claimed in claim 8, wherein said transition metal elements T in said R-T-B allowy are Fe and Co represented by $Fe_{1-x}Co_x$, x being 0.35 or less.

11. A method as claimed in claim 1, wherein said molten R-T-B alloy is ejected through a small orifice onto an outer peripheral chill surface of a quenching disk rotating at a predetermined speed in said rapidly-quenching step, said ejected molten alloy thereby beign rapidly cooled into the rapidly-quenching ribbons and/or ribbon-like flakes.

12. A method as claimed in claim 11, wherein a magnetic field is applied in a radial direction of said quenching disk so that said ejected molten alloy is cooled in said magnetic field.

13. A method as claimed in claim 11, wherein said quenching disk is provided with a plurality of projections formed in said chilling surface and a cooling plate is disposed adjacent said quenching disk, said molten alloy ejected onto the chilling surface is sprayed onto said cooling plate to form flat ribbon-like flakes.

14. A method as claimed in claim 13, wherein each of said flat ribbon-like flakes has a thickness of 7–500 μm.

15. A method as claimed in claim 1, wherein said molten R-T-B alloy is sprayed and atomized through a spray nozzle onto a cooling plate and rapidly cooled on said cooling plate to form flat ribbon-like flakes.

16. A method as claimed in claim 11, wherein after said molten alloy is deposited onto said chilling surface and is rapidly quenched to form a ribbon, an outer surface of said ribbon is rapidly quenched by engagement with another quenching disk to obtain a rapidly-quenched ribbon.

17. A method as claimed in claim 16, wherein said rapidly-quenched ribbon has a thickness of 20–1,000 μm.

18. A method as claimed in claim 1, wherein said rapidly-quenched ribbons and/or flakes are subjected to a heat treatment at a temperature of 650°–950° C.

* * * * *